US005794928A

United States Patent [19]

Araseki et al.

[11] Patent Number: 5,794,928

[45] Date of Patent: Aug. 18, 1998

[54] LARGE CAPACITY PAPER FEEDER FOR AN IMAGE FORMING APPARATUS

[75] Inventors: Yoshiyuki Araseki, Kakuda; Takenobu Kamada, Sendai; Hitoshi Kimura, Ogawara-machi, all of Japan

[73] Assignee: Tohoku Ricoh Co., Ltd., Miyagi-ken, Japan

[21] Appl. No.: 601,158

[22] Filed: Feb. 13, 1996

[30] Foreign Application Priority Data

Mar. 20, 1995 [JP] Japan ..... 7-061406

[51] Int. Cl.[6] ..... B65H 3/44; B65H 1/22

[52] U.S. Cl. ..... 271/9.08; 271/164; 271/157; 271/126

[58] Field of Search ..... 271/9.06, 9.07, 271/9.08, 147, 157–159, 126, 171, 162, 164

[56] References Cited

U.S. PATENT DOCUMENTS

| | | | |
|---|---|---|---|
| 4,332,375 | 6/1982 | Tsubo . | |
| 4,788,571 | 11/1988 | Ura et al. | 271/171 X |
| 5,431,383 | 7/1995 | Fujimoto et al. . | |
| 5,437,443 | 8/1995 | Miyata et al. . | |

FOREIGN PATENT DOCUMENTS

| | | | |
|---|---|---|---|
| 61-36517 | 10/1986 | Japan . | |
| 61-50858 | 11/1986 | Japan . | |
| 56225 | 3/1987 | Japan | 271/9.06 |
| 4-33691 | 6/1992 | Japan . | |
| 92486 | 4/1994 | Japan | 271/157 |
| 6-171819 | 6/1994 | Japan . | |
| 6-271104 | 9/1994 | Japan . | |
| 6-271118 | 9/1994 | Japan . | |
| 6-271119 | 9/1994 | Japan . | |
| 6-271120 | 9/1994 | Japan . | |
| 6-271124 | 9/1994 | Japan . | |

*Primary Examiner*—Boris Milef

*Attorney, Agent, or Firm*—Oblon, Spivak, McClelland, Maier & Neustadt, P.C.

[57] ABSTRACT

In an image forming apparatus, a large capacity paper feeder has a single pick-up roller capable of selectively feeding papers from an LCT (Large Capacity Table) or from a cassette removably mounted to the apparatus. The paper feeder, therefore, does not need a bulky paper feed unit for a cassette feed mode. In addition, a space for an LCT feed mode is not necessary above the pick-up roller, so that the height of the apparatus is not increased.

10 Claims, 20 Drawing Sheets

100
1
55
54
1F
58
58A
X
2
51a
3
52a
52b
51b
57
53
56
59
59a
6a
1a
1a
18c
4
5
27
1T
19
21
18g
9a
23
95
9b
25
6
7a
20a
(20b)
8b
22
24
8a
10
11
7
18
Pa
P1
Pb
P4
18d
18b(18a)
P2
P3
18e
18b(18a)
30
32
26a(26b)
26
36
31
Z

TRAY DOWN START

S20
DOWN-TO-P4 FLAG ON ?
NO
YES
RETURN
S21
START DRIVING TRAY DRIVING DEVICE
S22
NO
PAPER SURFACE SENSOR ON ?
YES
S23
INTERMEDIATE SENSOR ON ?
NO
YES
S24
CLEAR DOWN-TO-P4 FLAG
S25
STOP DRIVING TRAY DRIVING DEVICE
RETURN
S26
PAPER SURFACE SENSOR OFF ?
NO
YES
S27
CLEAR DOWN-TO-P4 FLAG
S28
STOP DRIVING TRAY DRIVING DEVICE
RETURN

INITIALIZATION
ELEVATE TRAY
S30
S31
UPPER LIMIT SENSOR ON ?
YES
NO
J1
S32
INTERMEDIATE SENSOR ON ?
YES
NO
S35
SET INTERMEDIATE-SENSE-ONCE FLAG
S33
PAPER SURFACE SENSOR ON ?
YES
NO
S36
SET PAPER-SURFACE-ONCE FLAG
S34
PAPER-SURFACE-ONCE FLAG ON ?
YES
NO
J1
S37
INTERMEDIATE-SENSE-ONCE FLAG ON ?
YES
NO
J1

LARGE CAPACITY PAPER FEEDER FOR AN IMAGE FORMING APPARATUS

BACKGROUND OF THE INVENTION

The present invention relates to a copier, printer, facsimile apparatus or similar image forming apparatus and, more particularly, to a large capacity paper feeder for feeding a great amount of papers or recording media to the image forming apparatus.

A paper feeder with a large capacity table (LCT) is usable with an electrophotographic copier or similar image forming apparatus. Usually, the LCT is capable of stacking 1,000 or more papers thereon. Hence, the LCT is desirable when images representative of documents of the same size should be sequentially formed on papers of the same size by use of, e.g., a sorter, or when papers of particular size frequency used in daily office work should be replenished a minimum number of times. However, when images are to be formed on papers different in size from the papers stacked on the LCT, such a number of papers existing on the LCT must be entirely removed from the LCT, resulting in labor-consuming work. In order to reduce the labor, Japanese Utility Model Publication No. 61-36517 and Japanese Patent Publication No. 4-33691, for example, each proposes an arrangement for allowing a cassette loaded with papers of particular size to be mounted to the paper feeder in addition to the LCT. However, this kind of scheme requires an exclusive paper feeding mechanism for the cassette in a cassette loading section, and paper transport paths each extending from one of the paper feeding mechanisms assigned to the LCT and cassette to a photoconductive drum.

A printer, particularly a stencil printer, is different from the electrophotographic copier in that it uses a master representative of a document image. Therefore, the stencil printer is desirable when a great number of printings must be produced from a single master. It is not rare that the stencil printer produces thousands of printings with a single master or document Japanese Patent Laid-Open Publication No. 6-171819, for example, discloses a stencil printer for office use and allowing about 1,000 papers to he stacked on its tray (table). To produce thousands of printings continuously with this stencil printer, there is needed a paper feeder with an LCT similar to the LCT of the electrophotographic copier. However, even with the stencil printer, it is sometimes necessary to change the size of papers to be used. Specifically, the stencil printer is not always operated to produce thousands of printings, and a great number of papers are sometimes left on the LCT. Because replacing the papers stacked on the LCT is labor-consuming, as stated earlier, a cassette for stacking papers different in size from the papers present on the LCT is essential. This, however, is not practicable without providing a cassette loading section with an exclusive paper feeding mechanism and an exclusive transport path, and therefore without increasing the size and cost of the mechanism. Particularly, the stencil printer transports the papers at a higher speed than the electrophotographic copier. Hence, if the papers are routed through such a complicated transport path, they are apt to jam the path or to be creased. In addition, it is likely that the accuracy of registration is lowered in the transport direction, and that the transport becomes defective when relatively thick papers are used.

Approaches to eliminate the above problems are taught in, e.g., Japanese Patent Laid-Open Publication Nos. 6-271104, 6-271118, and 6-271120. A paper feeder using any one of such approaches is implemented as a large capacity paper feeder with an interruption type cassette and feeding papers by use of a single pick-up roller. More specifically, this type of paper feeder allows the interruption type cassette to be mounted to the top of a paper feed unit. The paper feeder has the paper feed unit moved up and down when papers are fed from the cassette, a cassette table or first table formed with a notch for the pick-up roller to pass therethrough when the table is moved together with the paper feed unit, and an LCT or second table movable up and down in the paper feed unit independently. The paper feed unit and LCT are each moved up and down in a single frame by a respective drive mechanism. When the LCT is used, the top of the paper feed unit is brought to a position above the pick-up roller, so that papers can be fed from the LCT.

With the large capacity paper feeder having a single pick-up roller and operable with the cassette, it is necessary to promote the smooth switching between the cassette and the LCT, smooth replenishment of papers, and smooth jam processing. When the number of papers left on each of the cassette and LCT, particularly the LCT, is small, a substantial period of time is necessary for the LCT to rise from its lowered position to a paper feed position. In light of this, a control capable of setting up a paper feed condition in a short period of time is desired. Japanese Patent Laid-Open Publication Nos. 6-271119 and 6-271124, for example, propose implementations for meeting the above needs. Particularly, a paper feeder taught in the above 6-271119 has a LCT/cassette select button (T/K switch button) for allowing the operator to select either a cassette feed mode or an LCT feed mode, and a LCT/cassette down key (T/K down button; tray down key). When these buttons are operated in combination, a paper feed unit loaded with a cassette or an LCT is lowered for jam processing or paper replenishment. A paper feeder disclosed in the above 6-271124 includes cassette sensing means. When a power switch is turned on, the cassette sensing means outputs a signal indicative of whether or not the cassette is present. If the cassette is absent, mode setting means sets an LCT mode. In the LCT mode, the upward or downward movement of the LCT is so controlled as to feed papers from the LCT, so that the waiting time up to the start of printing is reduced.

However, the paper feeders disclosed in the above 6-271104, 6-271118, and 6-271120 have the following problems.

(1) To feed papers from the cassette, a bulky paper feed unit having the LCT thereinside is necessary. This, coupled with the drive mechanism for moving the paper feed unit up and down in the cassette feed mode, complicates the construction and increases the overall size of the paper feeder.

(2) In the LCT mode, a cassette table positioned in the upper portion of the paper feed unit is positioned above the pick-up roller. Hence, a substantial space for accommodating the cassette table must be provided above the pick-up roller. Particularly, in the stencil printer for office use and having a master making mechanism and a printing mechanism constructed integrally with each other, as taught in the above 6-171819, various sections including a master making section and a master discharging section arc each arranged at a particular position in the printer body. Hence, if the space is provided above the pick-up roller, the various sections of the printer body and, therefore, a document reading unit disposed above them must be shifted upward. As a result, the space increases the overall height of the printer. This not only increases the size of the stencil printer and that of the paper feeder, but also obstructs the easy stacking of documents on the document reading unit.

(3) The paper feeders shown and described in the above 6-271104, 6-271118 and 6-271120 need, due to their inherent constructions, a bulky cover which should be opened for mounting the cassette or for replenishing papers into the LCT or the cassette. The bulky cover is not desirable because it needs an exclusive space to be opened and closed, because it increases the size and cost of a mold, and because it is likely to cause the operator to stack papers in an unexpected position.

The above 6-271119 and 6-271124 have the following problems.

(4) in the paper feeder taught in the above 6-271119, when the cassette is used, the up-down movement of the paper feed unit must be controlled independently of the control for moving the LCT up and down. For this purpose, the T/K switch button and T/K down button are used in combination in order to control the downward movement of the LCT. This kind of operation is extremely troublesome. In addition, an increase in the number of buttons or keys directly translates into an increase in cost.

(5) The paper feeder disclosed in the above 6-271124 successfully reduces the waiting time when papers are fed from the LCT. However, when papers should be replenished while the cassette feed mode is set up, it is necessary for the operator to remove the cassette, operate the T/K switch button in order to select the LCT feed mode, and then press the T/K down button for lowering the LCT. With a stencil printer, it often occurs that thousands of printings are produced from a single document, as stated earlier. In such a case, even if the LCT is capable of being loaded with thousands of papers (usually, limited 3,000 to 4,000 because the height of the printer body is selected to be lower than 1 meter in consideration of maneuverbility, papers must be replenished, if short, before the start of printing. Hence, it is not always desirable from the maneuverbility standpoint, including replenishment, that the papers stacked on the LCT be located at the paper feed position. Rather, it is desirable that a certain amount of papers be easily replenished within a range which does not increase the waiting time up to the start of paper feed to a noticeable degree.

In order to eliminate the above problems (1)–(3), the present invention proposes a paper feeder which in a cassette feed mode does not move a bulky paper feed Unit up or down, but has a cassette driving mechanism independent of an LCT driving mechanism. Assigning an exclusive driving mechanism to a cassette is taught in previously mentioned 61-36517 or 4-33691. Further, Japanese Patent Publication No. 61-50858, for example, shows in its FIGS. 3 and 14 a cassette driving mechanism having a shaft (123) extending throughout the side panels of a casing, and a mechanism (59) for moving a tray (stack plate) included in the cassette up and down. The mechanism 59 is located at a position substantially corresponding to the center of the cassette in order to obviate, e.g., the inclination of papers stacked on the cassette, thereby insuring the stable movement of the cassette.

However, the above cassette driving mechanism has a problem that when both the papers of the LCT and the papers of the cassette are to be fed by a single paper feeding means (pick-up roller), an elevation member included in the mechanism 59 obstructs the elevation of the papers stacked on the LCT.

SUMMARY OF THE INVENTION

It is therefore an object of the present invention to provide a large capacity paper feeder for an image forming apparatus and capable of preventing the apparatus from being increased in size, i.e., height by obviating the need for a space for LCT paper feed.

It is another object of the present invention to provide a large capacity paper feeder for an image forming apparatus and having a simple mechanism and structure.

In accordance with the present invention, a paper feeder for an image forming apparatus has a single paper feeding member positioned at a paper feed opening and for feeding a paper from a top of a paper stack at a paper feed position in an intended direction of paper feed while separating the paper from the other papers. A casing constitutes an outside frame of the paper feeder. A pair of side fences are disposed in the casing and movable up and down for positioning opposite edges of the paper stack in a widthwise direction perpendicular to the intended direction of paper feed. A frame supports the side fences such that they are movable up and down between a predetermined upper position and a predetermined lower position of the casing. Biasing members constantly bias the frame upward relative to the casing. A tray is loaded with the paper stack, and movable up and down between an upper limit position facing the paper feed position and a lower limit position remotest from the upper limit position, and selectively causes the frame to move downward when the tray is moved downward. A tray driving mechanism moves the tray between the upper limit position and the lower limit position. When the tray is lowered to the lower limit position, a space is formed between a top of the frame and the paper feeding member for mounting a cassette capable of being loaded with a plurality of papers.

Also, in accordance with the present invention, a paper feeder for an image forming apparatus has a paper feeding member for feeding a paper from a top of a paper stack at a paper feed position while separating the paper from the other papers. A tray is loaded with the paper stack, and movable up and down between an upper limit position facing the paper feed position and a lower limit position remotest from the upper limit position. A tray moving mechanism moves the tray between the upper limit position and the lower limit position. A lower limit sensor senses that the tray has reached the lower limit position. A tray down setting device sets a downward movement of the tray. An illuminating device illuminates a portion of the tray down setting device to be operated. A controller causes the illuminating device to glow only when the tray is ready to be lowered, and causes the tray driving mechanism to lower the tray only when the illuminating device is glowing.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENT

Referring to FIGS. 1–16, a paper feeder embodying the present invention will be described together with a stencil printer loaded with the same. As shown, the printer or image forming apparatus, generally 1, has a printer frame or housing 1F, and a paper feeder 100 embodying the present invention and removably mounted to one side of the printer frame 1F.

Figure 1:
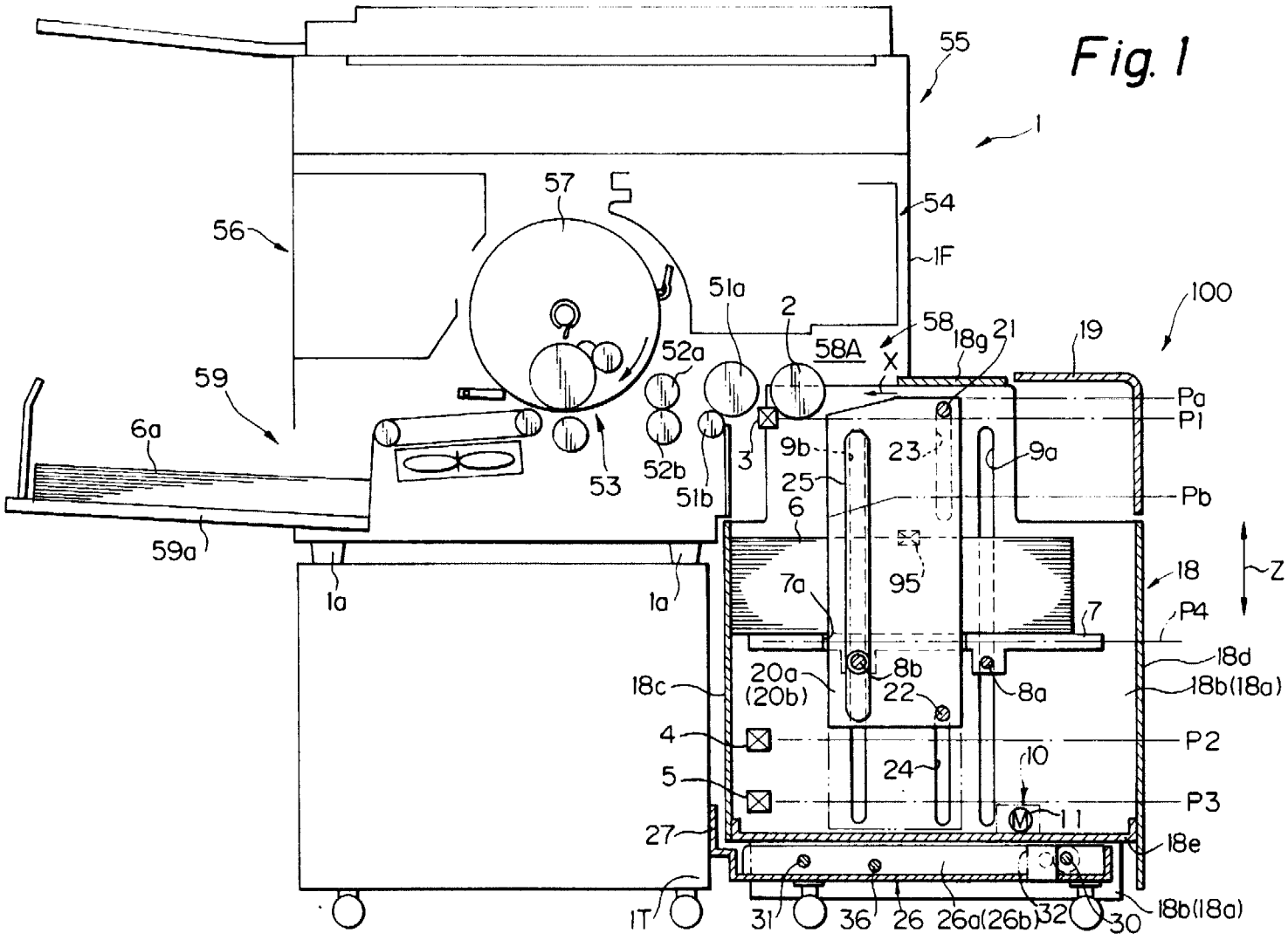
FIG. 1 is a sectional front view of a paper feeder embodying the present invention, and a stencil printer using it.

The printer 1 has a construction similar to the construction of a stencil printer taught in, e.g., Japanese Patent Laid-Open Publication No. 5-229243. As shown in FIG. 1, the printer 1 includes a document reading section 55. A master making and feeding section 54 is located above the paper feeder 100. The section 54 perforates a stencil paid out from a roll to thereby produce a master and then feeds it to a print drum 57 included in a print drum section 53. The master is wrapped around the print drum 57, although not shown specifically. A paper feeding section 58 feeds a paper 6 from a tray 7 or a paper 6' from a cassette 39 included in the paper feeder 100 to the print drum section 53. A paper discharging section 59 drives the paper, now labeled 6a, coming out of the print drum section 53 onto a paper discharging tray 59a. A master discharging section 56 is located at the opposite side to the master making and feeding section 54 with respect to the print drum 57. This section 56 includes a box, not shown, for collecting the used master removed from the print drum 57. The print drum section 53 constitutes the image forming section of an image forming apparatus.

A table 1T is positioned below the printer frame 1F. The printer frame 1F is positioned on and affixed to the table 1T via its affixing portions 1a. The paper feeder 100 has a stationary frame 26 in its lower portion. The stationary frame 26 is affixed to the lower portion of the right side of the table 1T, as viewed in the figures, via a mounting portion 27 forming a part of the frame 26. A pair of side panels 26a and 26b are affixed to the frame 26 at the right and the left with respect to an intended direction of paper feed X.

The paper feeder 100 has a pick-up roller or paper feeding means 2 for separating the uppermost one of the papers 6 stacked on the tray 7, and feeding it in the above direction X. A movable frame 18 constitutes the casing of the paper feeder 100. A pair of side fences 20a and 20b are accommodated in the movable frame 18 and movable up and down for positioning the opposite side edges of the papers 6 in a direction Y (see FIG. 5) perpendicular to the direction X, i.e., in the widthwise direction Y. Specifically, the side fences 20a and 20b are supported by a frame 28 (see FIG. 4) such that they are movable up and down between a predetermined upper position Pa and a predetermined lower position Pb, and are movable in the direction Y. A pair of tension springs or biasing means 114 (see FIG. 4) constantly bias the frame 28 upward. The tray 7 loaded with the paper stack 6 is movable between an upper limit position Pi facing the paper feed position and a lower limit position P3. Also, when the tray 7 is moved downward, it causes the frame 28 to move downward along with it. A tray driving device or driving means 10 causes the tray 7 to move between the above two positions P1 and P3. When the tray 7 is lowered to the lower limit position P3, a space 39S (see FIGS. 6 and 9) is formed between the top of the frame 28 and the pick-up roller 2. The cassette 39 capable of accommodating a plurality of papers 6' is removably inserted into the space 39S. At this instant, a cassette mounting and dismounting mechanism 47 (see FIG. 7) guides and positions the cassette 39. A cassette/tray driving device or stack member driving device 40 (see FIGS. 6 and 8) causes the papers 6' stacked on the cassette 39 to face the paper feed position.

The device 100 is selectively operable in a tray feed mode or a cassette feed mode under the control of an electric control system which will be described. The tray feed mode is set up when the cassette 39 is not mounted, and causes the papers 6 to be fed from the tray 7. The cassette feed mode is set up when the cassette 39 is mounted, and causes the paper 6' to be fed from the cassette 39. The tray 7 plays the role of a large capacity table (LCT) which can be loaded with a stack of 3,000 to 4,000 papers 6. In this sense, the paper feeder 100 is implemented as an elevatable LCT unit. On the other hand, the maximum number of papers 6' which can be stacked on the cassette 39 is usually about 500.

A reference will be made to FIGS. 1–15 for describing in detail the various constituents of the paper feeder 100, i.e., the pick-up roller 2, movable frame 18, side fences 20a and 20b, frame 28, tension springs 114, tray 7, tray driving device 10, cassette 39, cassette mounting and dismounting mechanism 47, and cassette/tray driving device 40. In FIGS. 3 and 4, the side fences 20a and 20b are not shown for clarity's sake.

As shown in FIG. 1, a separator roller 51a is mounted on a shaft, not shown, which is journalled to the side panels of the printer frame 1F. Pivotal arms, not shown, are connected to the shaft of the separator roller 51a at one end, and supports the pick-up roller 2 at the other or free end. The pick-up roller is positioned in a paper feed opening 58A formed in the paper feeding section 58. The pick-up roller 2 may be provided with a configuration taught in, e.g., Japanese Utility Model Publication No. 5-18342. The separator roller 51a cooperates with another separator roller 51b. There are also shown registration rollers 52a and 52b which cooperate with each other in a conventional manner.

The movable frame 18 is disposed above the stationary frame 26 and movable in the widthwise direction Y via a shaft member which will be described. The movable frame 18 has a generally box-like configuration made up of a pair of side panels 18a and 18b positioned at the right and the left with respect to the paper feed direction X, a pair of side panels 18c and 18d positioned at the front and the rear in the direction X, a top panel 18g intervening between the panels 18*a* and 18*b* and slidable in the direction X, and a bottom panel 18*e* affixed to the bottoms of the panels 18*a*–18*d*.

Figure 2:
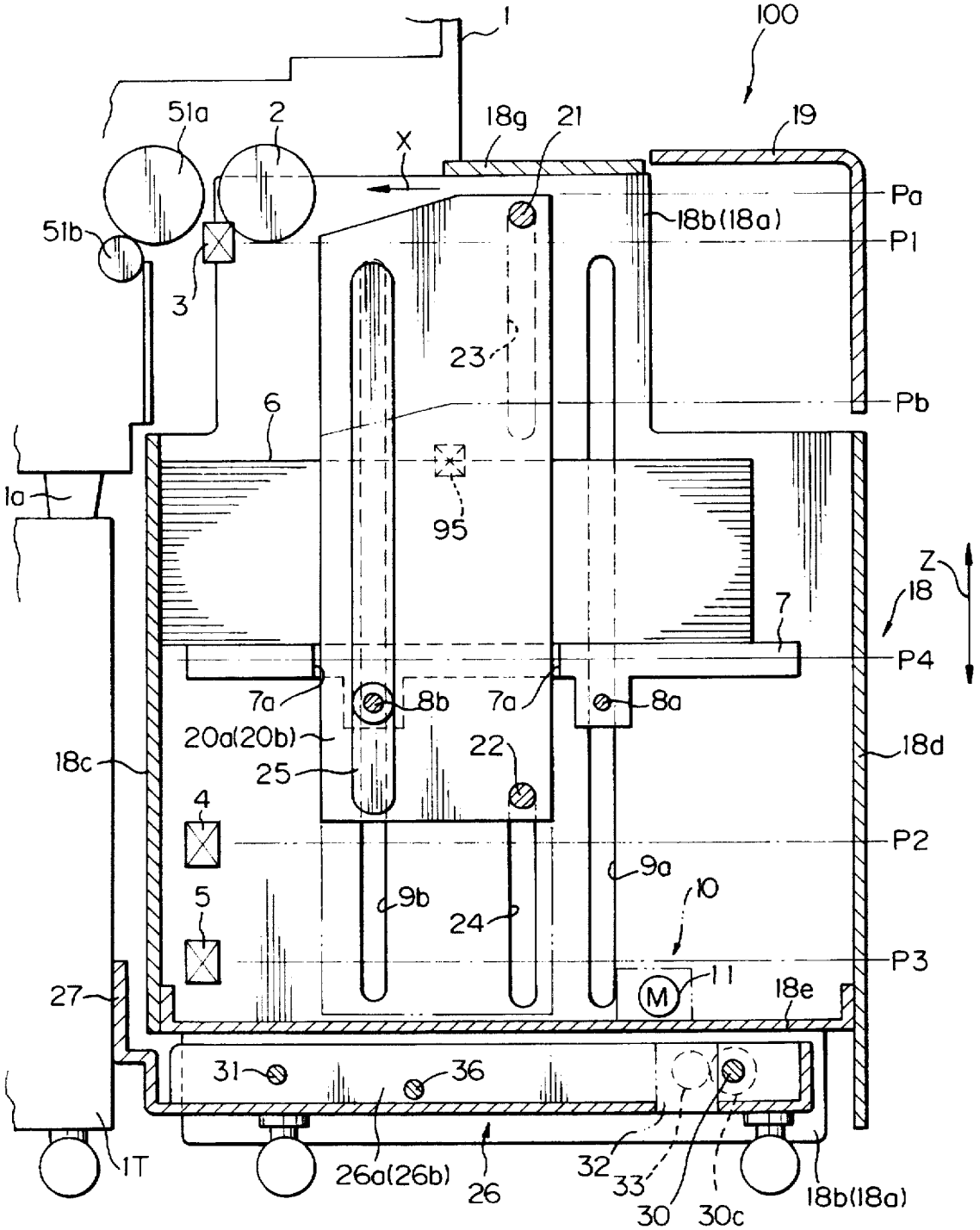
FIG. 2 is a sectional front view showing the embodiment in an enlarged scale.
Figure 3:
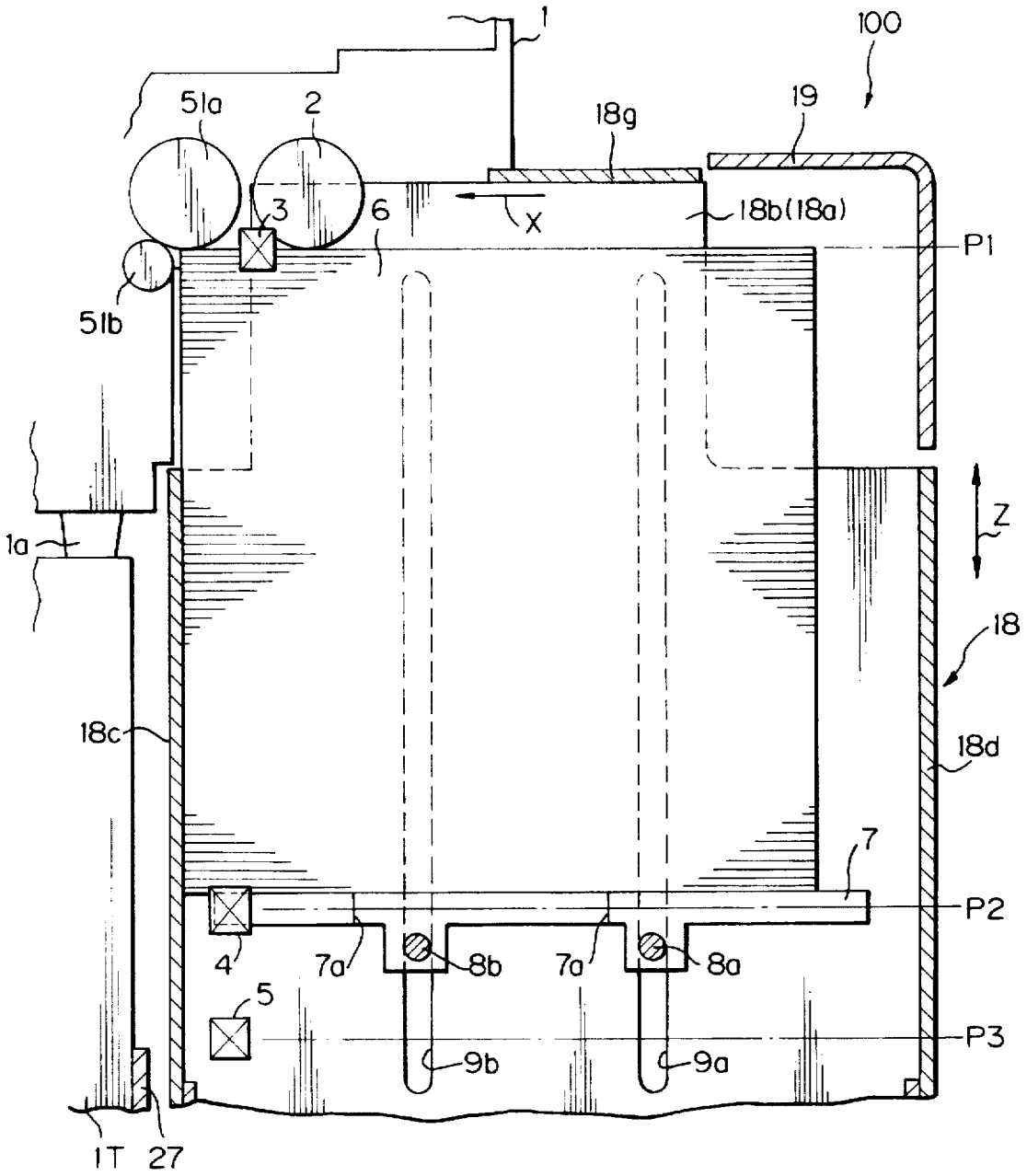
FIG. 3 is a sectional front view showing how the embodiment feeds papers in a full load condition.
Figure 4:
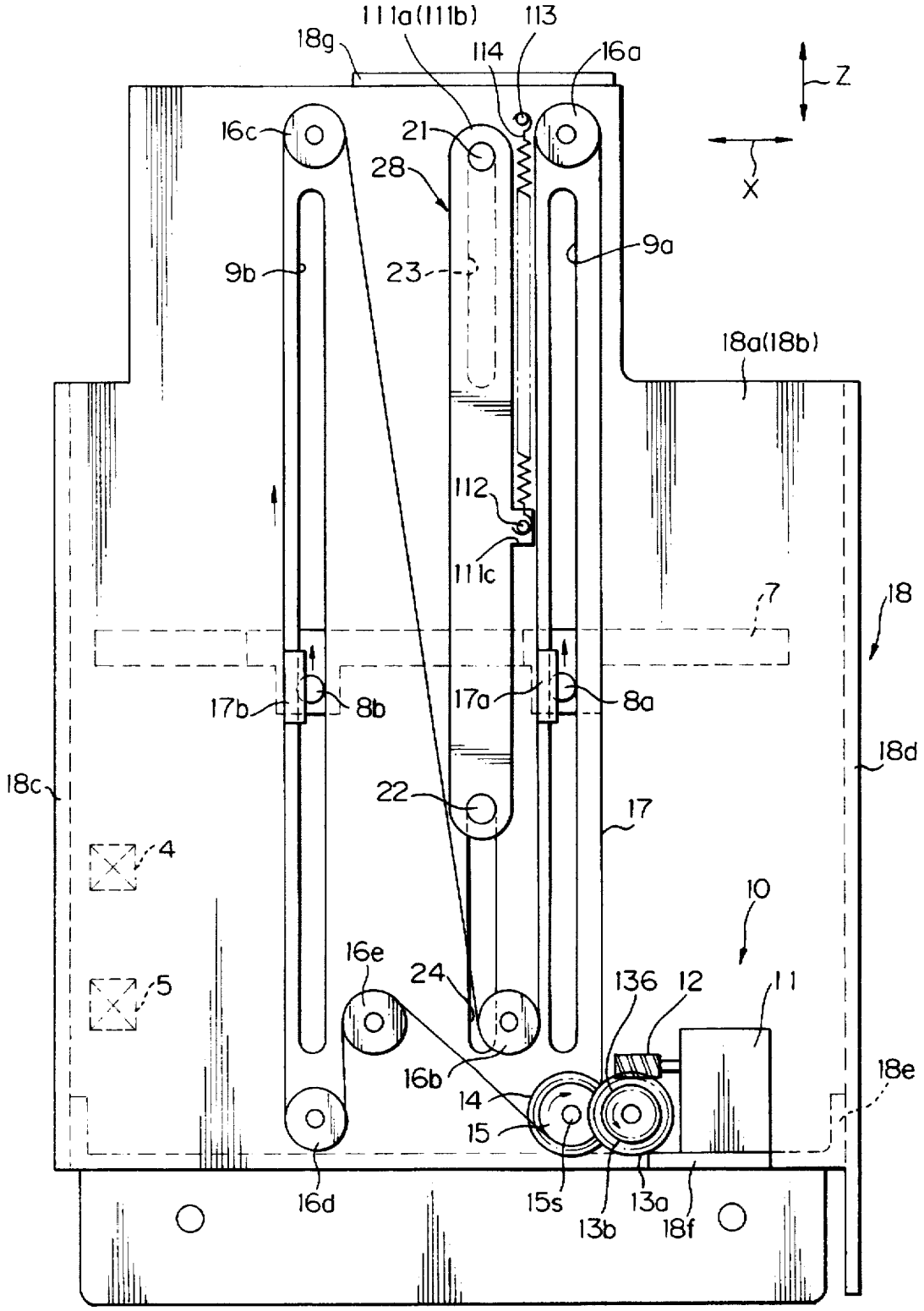
FIG. 4 is a front view showing the arrangement of a tray driving device and a frame included in the embodiment.

While the paper feeder 100 is in operation, the top panel 18*g* is located at the right position shown in, e.g., FIGS. 1, 2 and 3. In this position, the panel 18*g* closes the top of the device 100 so as to prevent noise from leaking to the outside and to insure safety operation. When the papers 6 should be replenished into the tray 7 or when a jamming paper should be removed, the panel 18*g* is slid to the left position in the above figures. This, coupled with the opening of a cover 19 which will be described, forms a wide opening at the top of the paper feeder 100.

Figure 11:
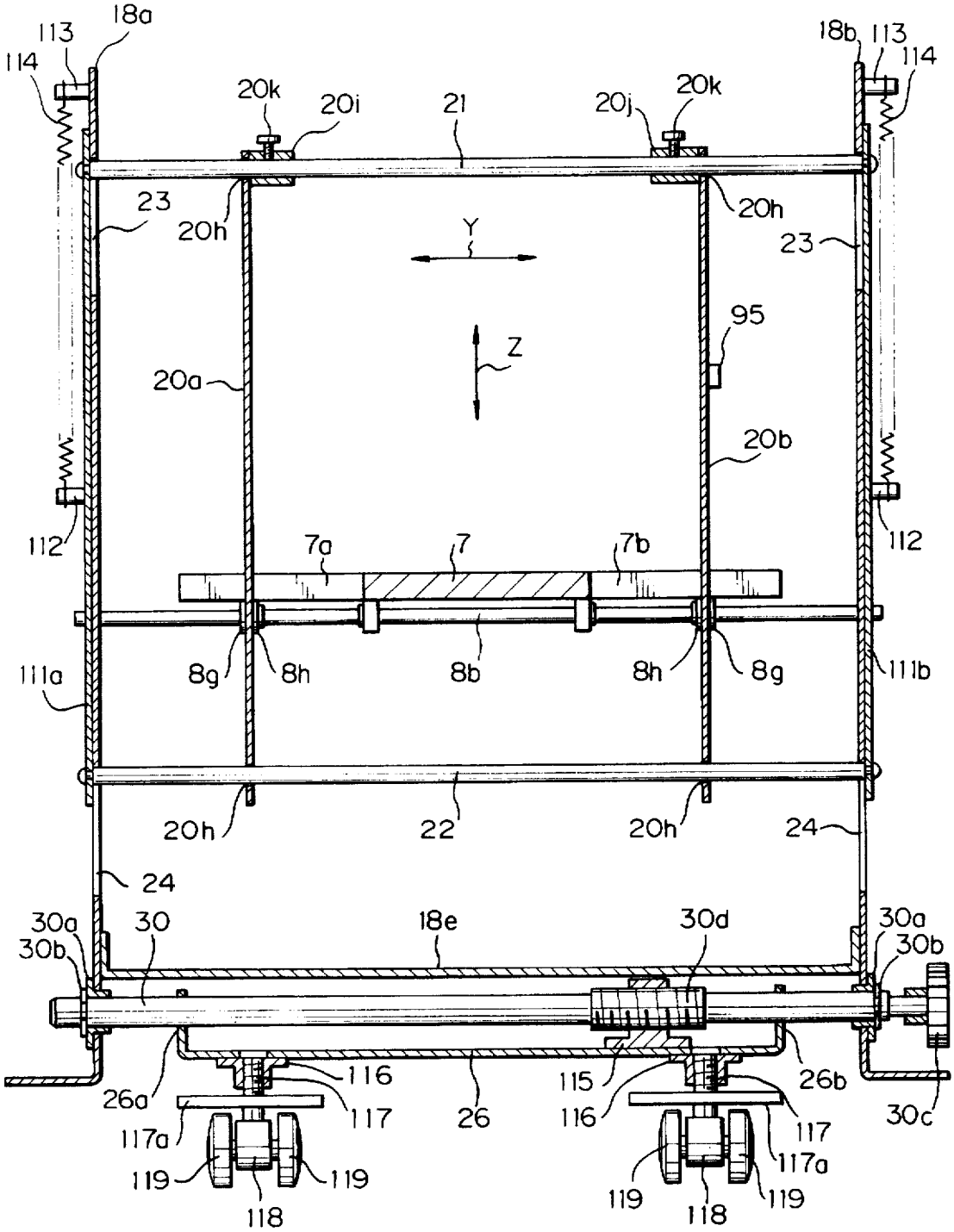
FIG. 11 is a partly sectional side elevation also showing the frame, side fences, and tray.

As shown in FIGS. 2 and 11 in detail, a guide shaft 31 and a drive shaft 30 are assigned to the movable frame 18 and parallel to each other in the direction Y. The shafts 31 and 30 extend throughout the side panels 26*a*, 26*b*, 18*a* and 18*b*. Specifically, the shaft 30 is journalled to the lower end portions of the side panels 18*a* and 18*b* via bearings 30*a*. Stop rings 30*b* are fitted on opposite ends of the shaft 30 which are supported by the bearings 30*a*, so that the shaft 30 is prevented from slipping out of the side panels 18*a* and 18*b* in the direction Y. As shown in FIG. 11, a male screw-thread 30*d* is formed in substantially the intermediate portion of the shaft 30. A guide holder 115 is affixed to substantially the intermediate portion of the stationary frame 26 and formed with a female screw-thread meshing with the above thread 30*d*. A motor 32 (FIGS. 1 and 2) is located in the vicinity of one end of the shaft 30 and drivably connected to one end of the shaft 30 via reduction gears 33 and 30*c*.

Figure 5:
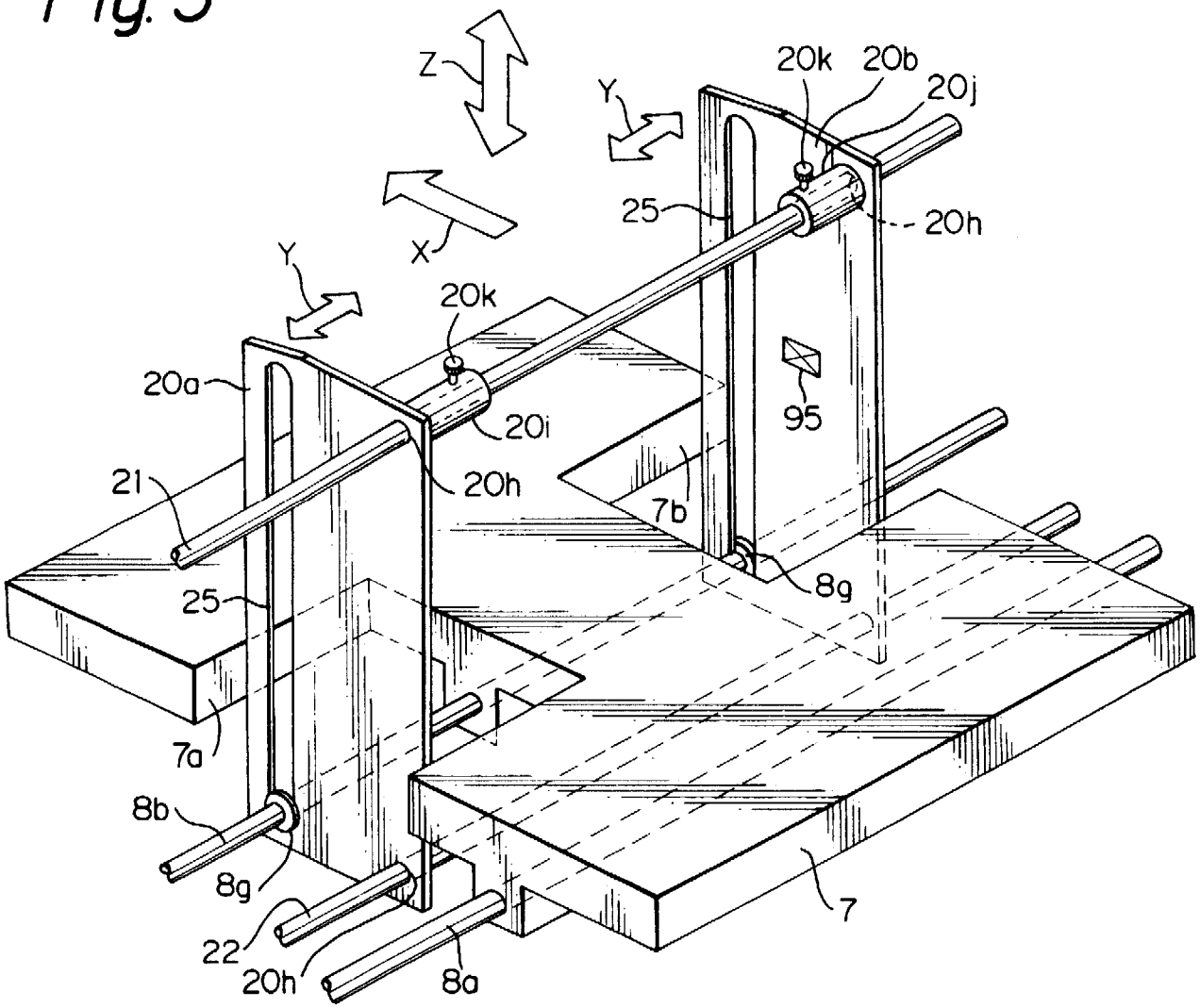
FIG. 5 is a perspective view of a tray, side fences and their associated members also included in the embodiment.

As shown in FIG. 5 in detail, the tray 7 is generally H-shaped, as seen in a plan view, and positioned inside of the movable frame 18. Notches 7*a* and 7*b* are formed in substantially the intermediate portion of the tray 7 with respect to the direction Y. Tray drive shafts 8*a* and 8*b* are respectively affixed to the bottom of the rear portion of the tray 7 with respect to the direction X, and the bottom of the notched portion of the tray 7. The drive shafts 8*a* and 8*b* extend in the direction Y in parallel to each other in the direction Y. The side fences 20*a* and 20*b* are respectively movable in the notches 7*a* and 7*b* in the direction Y, and movable up and down in the direction Z perpendicular to the directions X and Y.

As shown in FIG. 5, guide slots 25 are respectively formed in the front portions of the side fences 20*a* and 20*b*. The guide slots 25 extend in the above direction Z in parallel to each other. A tray drive shaft 8*b* is passed through the guide slots 25 with the intermediary of a guide sleeve 8*g*. The guide sleeve 8*g* is made up of flange portions and sleeve portions. The flange portions each has an outside diameter greater than the width of the guide slots 25, and guides the shaft 8*b* in the direction Z. The sleeve portions are respectively loosely fitted between the slots 25 and the associated portions of the shaft 8*b*, and slidable in the direction Y. Holes 20*h* are formed in the rear portion of each of the side fences 20*a* and 20*b*. An upper shaft 21 and a lower shaft 22 are respectively loosely received in the upper aligned holes 20*h* and lower aligned holes 20*h* of the side fences 20*a* and 20*b*. The side fences 20*a* and 20*b* are slidably guided by the shafts 21 and 22. In this configuration, the side fences 20*a* and 20*b* are respectively movable in the notches 7*a* and 7*b* while sliding on the shafts 8*b*, 21 and 22, thereby positioning the side edges of the paper stack 6 in the direction Y.

Guide sleeves 20*i* and 20*j* are respectively loosely coupled over the upper shaft 21 at the inside of the holes 20*h* of the guide fences 20*a* and 20*b*. The guide sleeves 20*i* and 20*j* are each formed with a female screw-thread substantially perpendicular to the axis of the shaft 21. A stop screw 20*k* is held in mesh with the female screw-thread. After the side fences 20*a* and 20*b* have been moved in the direction Y in order to position the paper stack 6, the stop screws 20*k* are driven into the associated female screw-threads. As a result, the guide sleeves 20*i* and 20*j* are fastened to the shaft 21.

Figure 10:
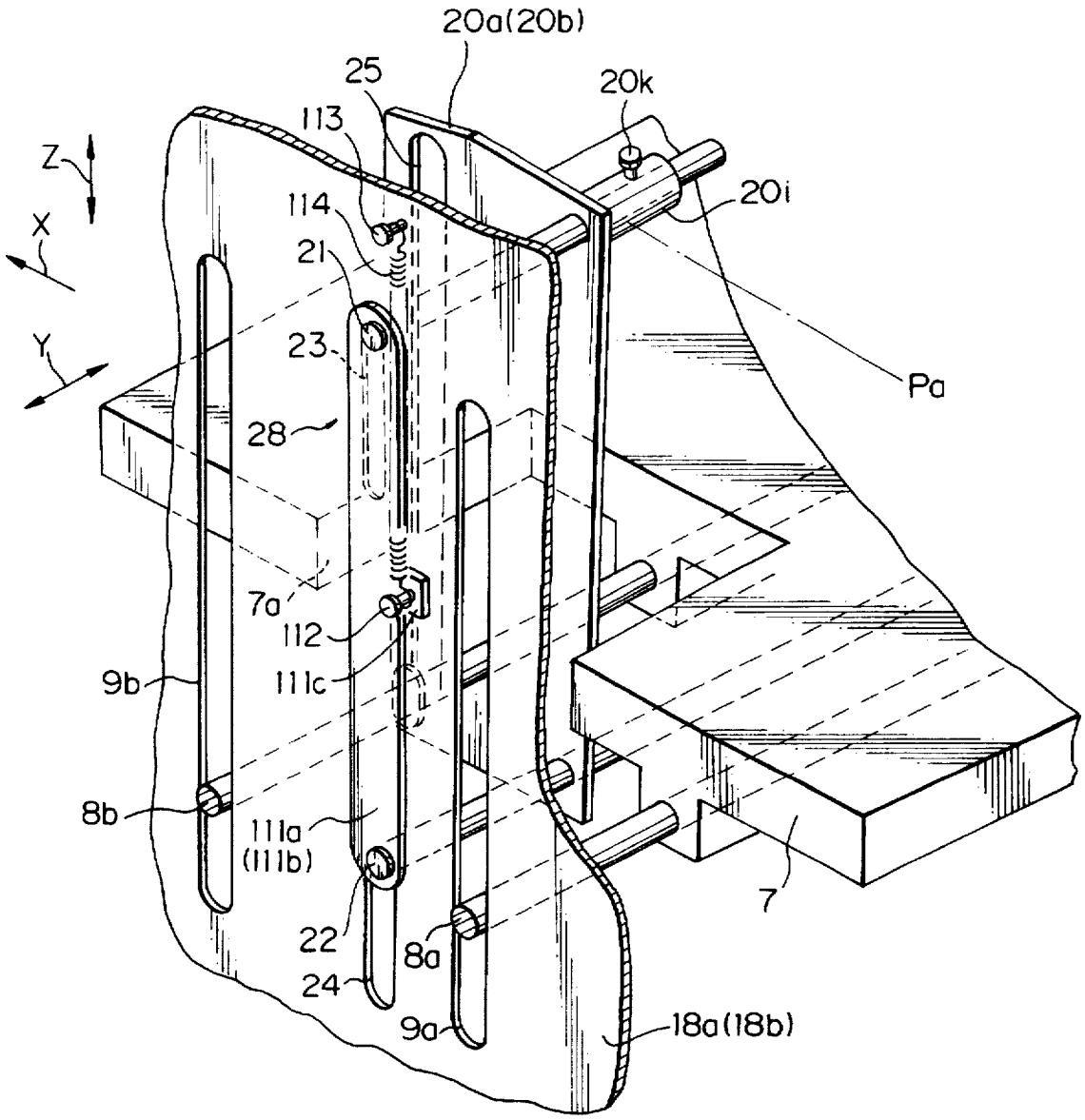
FIG. 10 is a fragmentary perspective view showing the frame, side fences, and tray.

As shown in FIGS. 4 and 10, the side panels 18*a* and 18*b* of the movable frame 18 are each formed with parallel guide slots 9*a* and 9*b* for guiding the shafts 8*a* and 8*b* in the direction Z. The slots 9*a* and 9*b* are longer than the previously mentioned slots 25 in the direction Z. Further, the side panels 18*a* and 18*b* are each formed with an upper guide slot 23 and a lower guide slot 24 between the guide slots 9*a* and 9*b*. These upper and lower guide slots 23 and 24 respectively guide the shafts 21 and 22 in the direction Z, and have a smaller length than the guide slots 25 in the direction The frame 28 consists of the upper and lower shafts 21 and 22, and a pair of tie members 111*a* and 111*b* which will be described.

As shown in FIGS. 4, 10, 11 and 12, the upper shaft 21 passed through the upper guide slots 23 is affixed at its opposite ends to the upper ends of the right and left tie members 111*a* and 111*b*. The tie members 111*a* and 111*b* are movable in the direction Z along the outer surfaces of the side panels 18*a* and 18*b*, respectively. Likewise, the lower shaft 22 passed through the lower guide slots 24 is affixed at its opposite ends to the lower ends of the tic members 111*a* and 111*b*. Therefore, the shafts 21 and 22 and tie members 111*a* and 111*b* constitute a single relatively small frame 28.

Pins 113 are respectively studded on the side panels 18*a* and 18*b* above the guide slots 23, while pins 112 arc respectively studded on tugs 111*c* positioned at substantially the centers of the tie members 111*a* and 111*b*. The previously mentioned tension springs 114 are each anchored to the pins 113 and 112. In this condition, the frame 28 is movable up and down over the entire upper guide slots 23 and lower guide slots 24, while being constantly biased upward by the springs 114. Consequently, the side fences 20*a* and 20*b* are constantly biased upward relative to the movable frame 18. When the tray 7 is moved upward, the frame 28 is also moved upward with the upper shaft 22 contacting the underside of the tray 7. When the upper and lower shafts 21 and 22 respectively abut against the upper edges of the associated guide slots 23 and 24, the elevation of the shafts 21 and 22 is stopped; the side fences 20*a* and 20*b* are each brought to a stop at a position indicated by a solid line in FIGS. 1 and 2. When the tray 7 is further elevated due to the consumption of the papers 6, the shaft 8*b* slides in the guide slots 25, raising the tray 7 relative to the side fences 20*a* and 20*b*. As a result, all the papers 6 existing on the tray 7 can be surely fed in contact with the pick-up roller 2.

As stated above, the side fences 20*a* and 20*b* are moved between the upper limit position Pa and the lower limit position Pb by a fence driving mechanism consisting of the springs 114 and the lower shaft 22. The lower shaft or fence moving member 22 forms a part of the frame 28, and contacts the underside of the tray 7 by being selectively interlocked with the downward movement of the tray 7, thereby lowering the side fences 20*a* and 20*b*.

The frame 28, including the side fences 20*a* and 20*b* is bodily elevatable together with the tray 7 over the preselected range between the two limit positions Pa and Pb. This eliminates the need for an exclusive mechanism for driving the side fences 20*a* and 20*b*. Because the frame 28 is simple in construction, small, and light weight, the springs 114 do not have to exert an intense biasing force. Further, when the frame 28 is lowered in interlocked relation to the tray 7, the load acting on a motor 11 which will be described is light. This promotes the miniaturization of the motor 11. When the tray 7 is lowered toward the position P3 for the insertion of the cassette 39, the frame 28 is lowered together with the tray 7 until the space 39S (see FIGS. 6 and 9) has been formed. In this case, too, it is not necessary to use an exclusive mechanism for lowering the frame 28.

Figure 9:
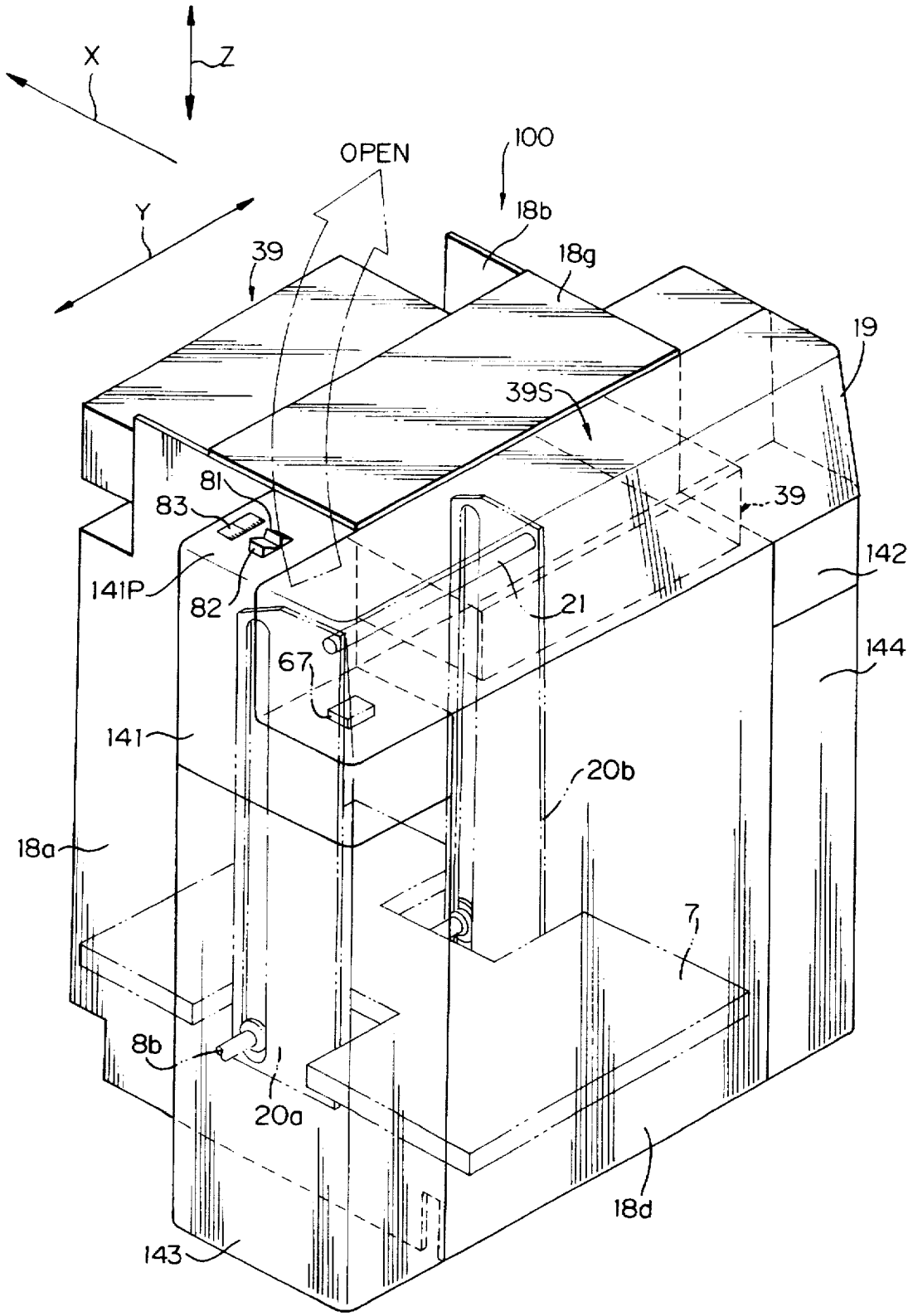
FIG. 9 is a perspective view of the embodiment.

As shown in FIG. 9, lower covers 143 and 144 are respectively mounted on the rear lower portions of the outer surfaces of the side panels 18*a* and 18*b*. Upper covers 141 and 142 are respectively mounted on the rear upper portions of the side panels 18*a* and 18*b* above the lower covers 143 and 144, and each has a stepped configuration. A cover 19 openably closes a paper feed opening communicated to the space 39S at the position above the side panel 18*d* and the stepped portions of the upper covers 141 and 142. The cover 19 is mounted on a shaft, not shown, journalled to the cover 19 and side panel 18*b*. When the cassette 39 should be mounted or dismounted, when the papers 6 or the papers 6' should be replenished into the tray 7 or the cassette 39, or when a jamming paper should be removed, the cover 19 is openable about the above shaft over an angle of about 100 degrees in the direction indicated by a bold arrow in FIG. 9.

As shown in FIG. 4 in detail, the motor 11 included in a tray driving device 10 is mounted on a motor support 18*f* which is formed integrally with the side panel 18*a* below the guide slot 9*a*. A worm 12 is affixed to the output shaft of the motor 11. Drive pulleys 15 are mounted on opposite ends of a shaft 15*s* which is journalled to the side panels 18*a* and 18*b*. A drive pulley gear 14 is affixed to the pulley 15. An idler gear 13*b* is disposed between the worm 12 and the gear 14 and held in mesh with the gear 14. A worm wheel 13*a* is mounted on the same shaft as the idler gear 13*b* and held in mesh with the worm 12. Intermediate pulleys 16*a*–16*e* are rotatably mounted on predetermined positions of each of the side panels 18*a* and 18*b*. Drive belts 17 are passed over the drive pulleys 15 and pulleys 16*a*–16*e*. Belt stays 17*a* and 17*b* are affixed to predetermined positions of the belts 17. The tray drive shafts 8*a* and 8*b* have their opposite ends affixed to the belt stays 17*a* and 17*b* at both ends thereof. It is to be noted that the constituent parts of the device 10 except for the motor 11, worm 12, gear 14, idler gear 13*b* and worm wheel 13*a* are also provided on the other side panel 1*b*, although no shown specifically.

Figure 16:
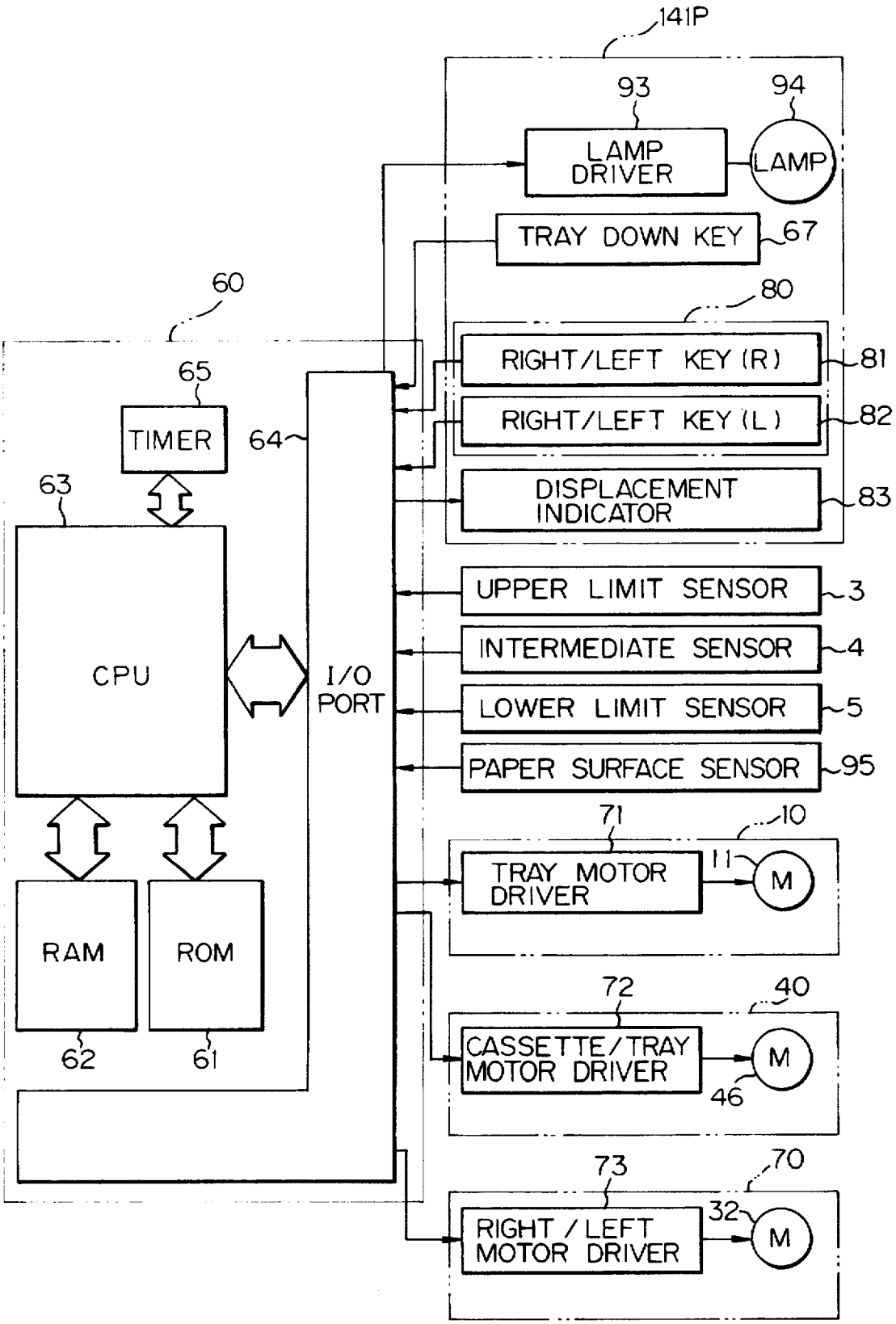
FIG. 16 is a block diagram schematically showing an electric control system additionally included in the embodiment.

The motor 11 is implemented as a reversible DC motor. The drive belts 17 are timing belts formed with teeth. Likewise, the pulleys 15 and intermediate pulleys 16*a*–16*e* are provided with a conventional toothed configuration. As shown in FIG. 16, the motor 11 is electrically connected to control means 60 via a motor drive circuit 71. Assume that the worm 12 and worm wheel 13*a* are configured such that when the motor 11 is rotated clockwise or in the forward direction, the drive pulleys 15 is rotated clockwise via the worm 12, worm wheel 13*a*, idler gear 13*b*, and gear 14. Then, the above rotation of the motor 11 causes the opposite ends of the shafts 8*a* and 8*b* affixed to the belts 17, i.e., the tray 7 is elevated at a constant speed. When the motor 11 is reversed, i.e., rotated counterclockwise, the tray 7 is lowered at a constant speed. In this manner, the tray 7 is selectively raised or lowered in parallel to the paper feed direction X while remaining in substantially the horizontal position. At this instant, the worm 12 and worm wheel 13*a* meshing with each other prevent the gear 14 and idler gear 13*b* from rotating despite the weight of the tray 7. Hence, when the motor 11 is energized, the tray 7 is immediately brought to a stop.

Referring to FIGS. 6–9 and 12–15, arrangements relating to the cassette 39 and how the device 100 operates with the cassette 39 will be described.

Figure 6:
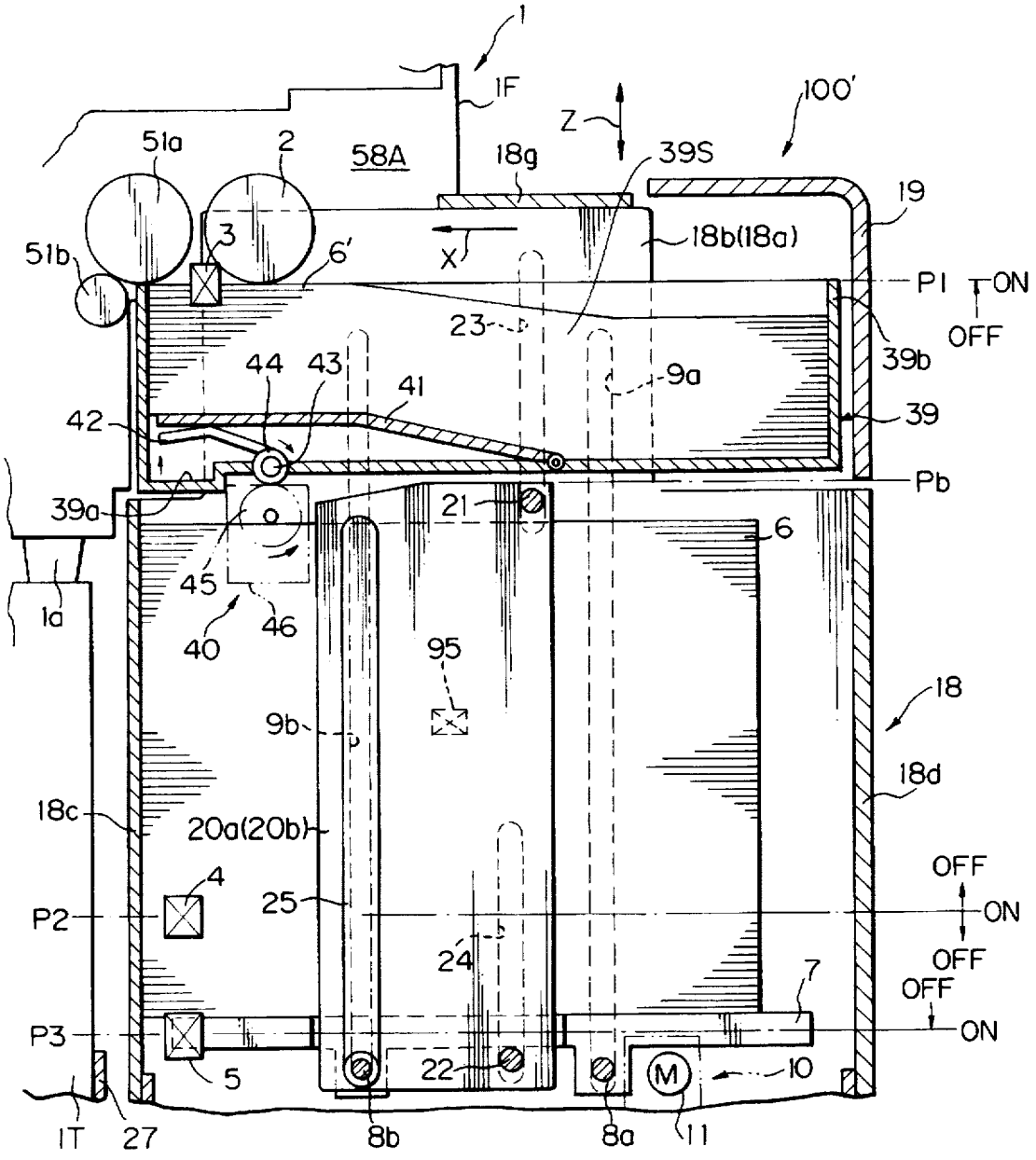
FIG. 6 is a sectional front view showing the arrangement of a cassette and its associated members also included in the embodiment, and demonstrating the operation of the embodiment with the cassette mounted thereto.

As shown in FIG. 6, the cassette 39 has a top-open box-like case 39*b*, a rotatable stack plate 41 to be loaded with a paper stack and positioned in the front half of the bottom wall of the case 39*b*, a shaft 43 rotatably supported by the bottom wall of the case 39*b* below the stack plate 41, a gear 44 mounted on one end of the shaft 43 and selectively engageable with a drive member or drive transmission member, which will be described, for moving the stack plate 41 up and down, and an arm 42 affixed to the shaft 43.

Figure 13:
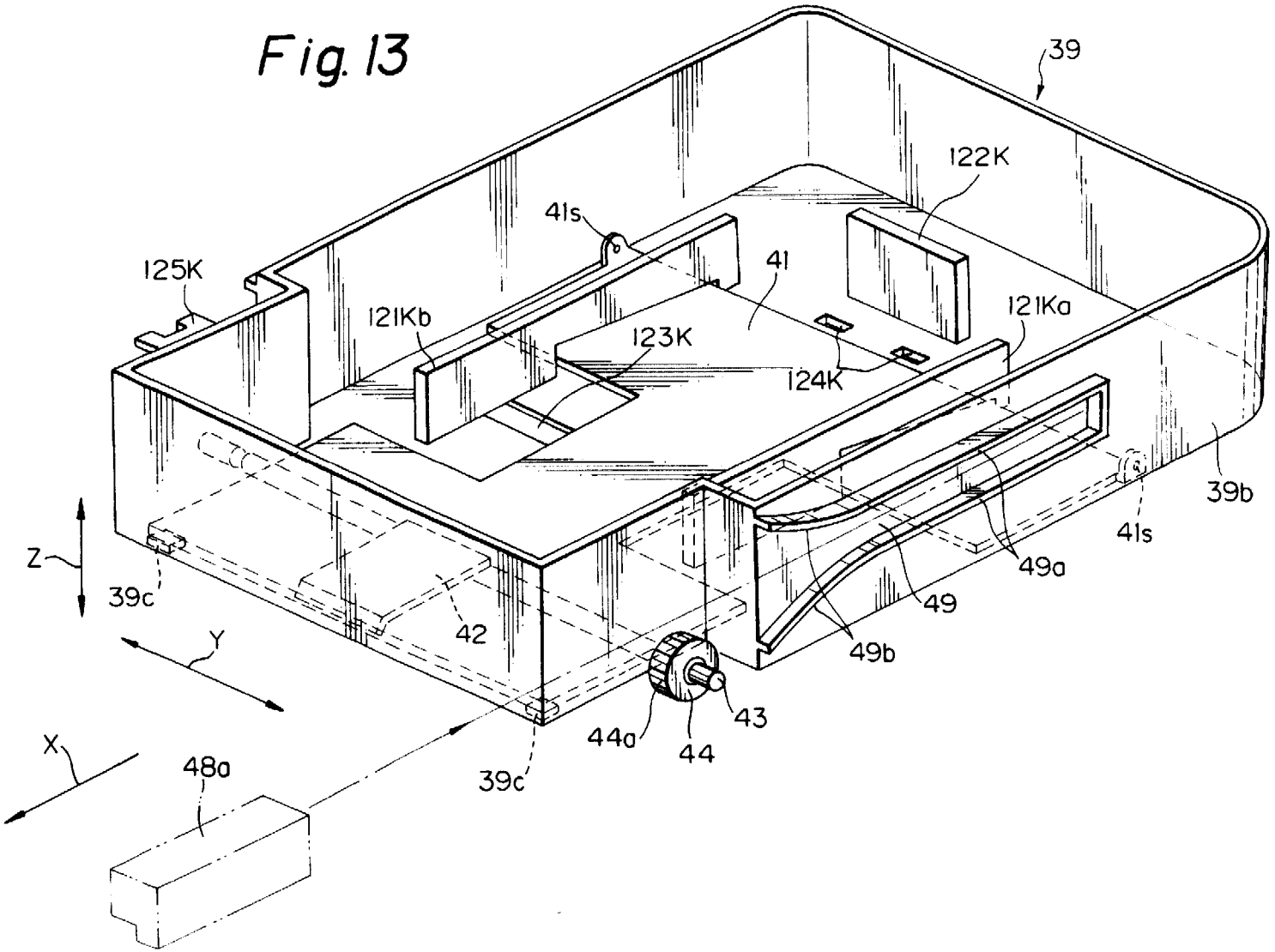
FIG. 13 is a perspective view showing the cassette and its associated members.

As shown in FIGS. 6–9 and 13, the case 39*b* is formed with a recess 39*a* in the bottom wall thereof for accommodating the arm 42 when the papers are not fed. A stop 39*c* is formed on the inner surface of the front wall of the case 39*b*. The stop 39*c* defines the lowermost position of the stack plate 41. The case 39*b* is formed of acrylonitrile butadien styrene (ABS) or similar synthetic resin while the stack plate 41 and arm 42 are formed of steel. Guide channels 49 are formed in the outer surfaces of the opposite side walls of the cassette 39. After the guide channels 49 have been respectively engaged with cassette guides 48*a* and 48*b*, they guide the cassette 39 being slid in the direction X or in the opposite direction. As shown in FIG. 13, the guide channels 49 may each be implemented as ribs 49*a* formed on the side wall of the case 39*b*. The ribs 49*a* have arcuate inlet portions 49*b* inclined upward and downward, respectively, so that the associated cassette guides 48*a* and 48*b* can be easily inserted into the ribs 49*a*.

As shown in FIG. 13, a right and a left cassette side fence 121K*a* and 121K*b* are provided in the cassette 39. The side fences 121K*a* and 121K*b* are movable in the direction Y along a guide channel 123K formed in the bottom wall of the case 39*b* and extending in the direction Y. A locking mechanism, not shown, allows the side fences 121 to be locked in a desired position within the range of the guide channel 123, so that he paper stack 6' can have its side edges in the direction Y positioned. A plurality of holes 124K are formed in the bottom wall of the case 39*b* and spaced a predetermined distance in the direction X. An end plate 122K is fitted in particular ones of the holes 124K matching the size of the papers 6' so as to stop the rear edges of the papers 6' in the direction X. An actuator 125K actuates a cassette size sensor, not shown, mounted on the side panel 18*b* and implemented by a transmission type photosensor. The output of the cassette size sensor is representative of the size of the papers 6' stacked on the cassette 39. The actuator 125K can be fastened or otherwise affixed to the case 39*b* by the user on the basis of the paper size.

Figure 8:
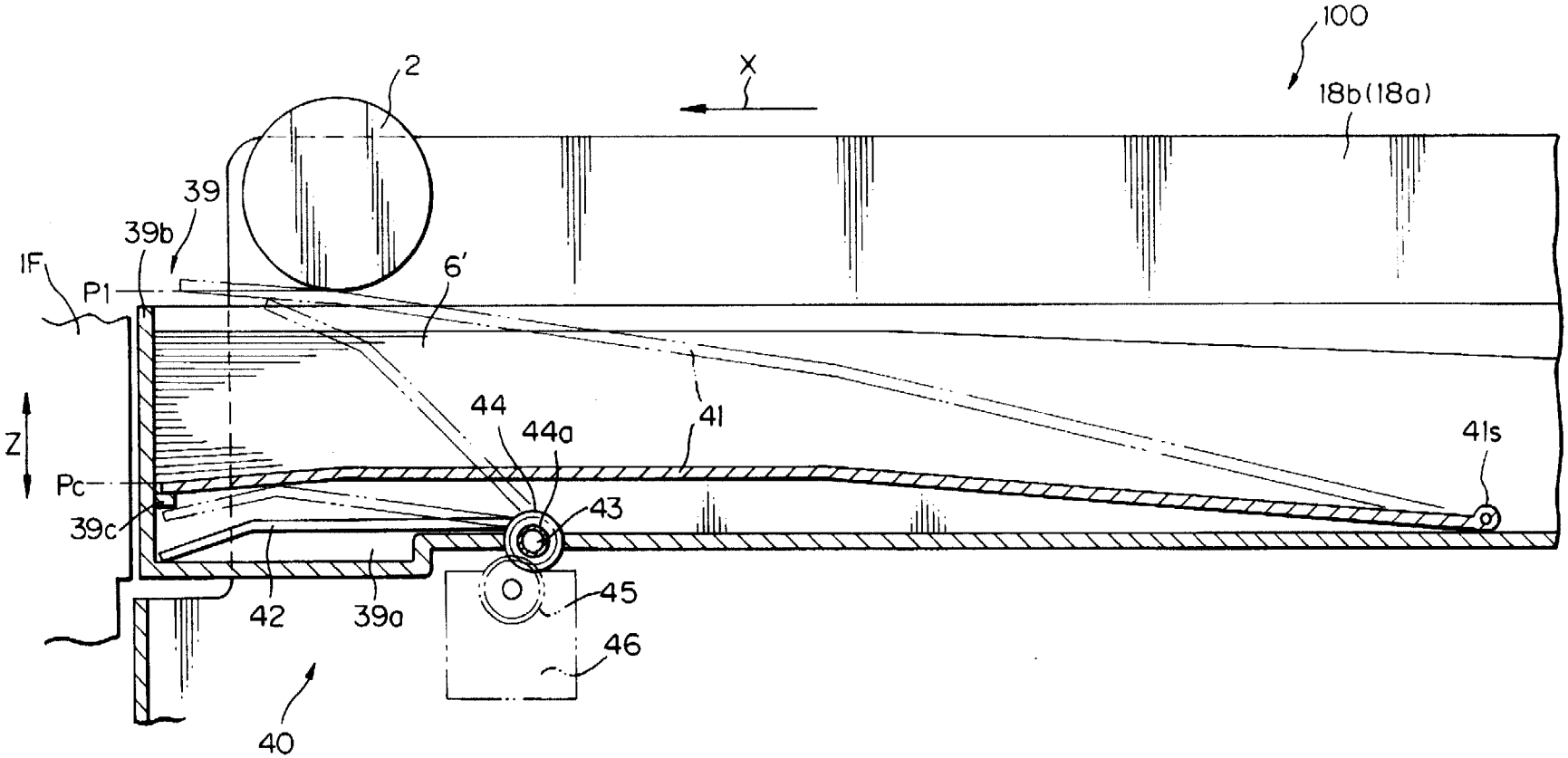
FIG. 8 is a fragmentary enlarged sectional side elevation showing a cassette/tray driving mechanism also included in the embodiment.

As shown in FIG. 8, the stack plate 41 is mounted at one end on a shaft 41*s* which is rotatably supported by the bottom wall of the case 39*b*. The other or free end portion of the stack plate 41 is rotatable about the shaft 41*s* in the direction Z. Specifically, the stack plate 41 is movable between an upper limit position P1 facing the previously mentioned paper feed position and a lower limit position Pc remote from the position P1. The case 39*b* has a height of about 50 mm to 80 mm in the direction Z. The arm 42 is angled, as viewed in a section, and positioned such that its bend contacts the free end portion of the stack plate 41. The cassette 39 is a so-called interruption type cassette and used when, e.g., the paper size should be changed or when the papers 6' should be replaced with color papers. Usually, about 500 papers 6' can be stacked on the cassette 39, as stated earlier. It is to be noted that the recess 39*a* for receiving the arm 42 may be replaced with a notch.

Figure 7:
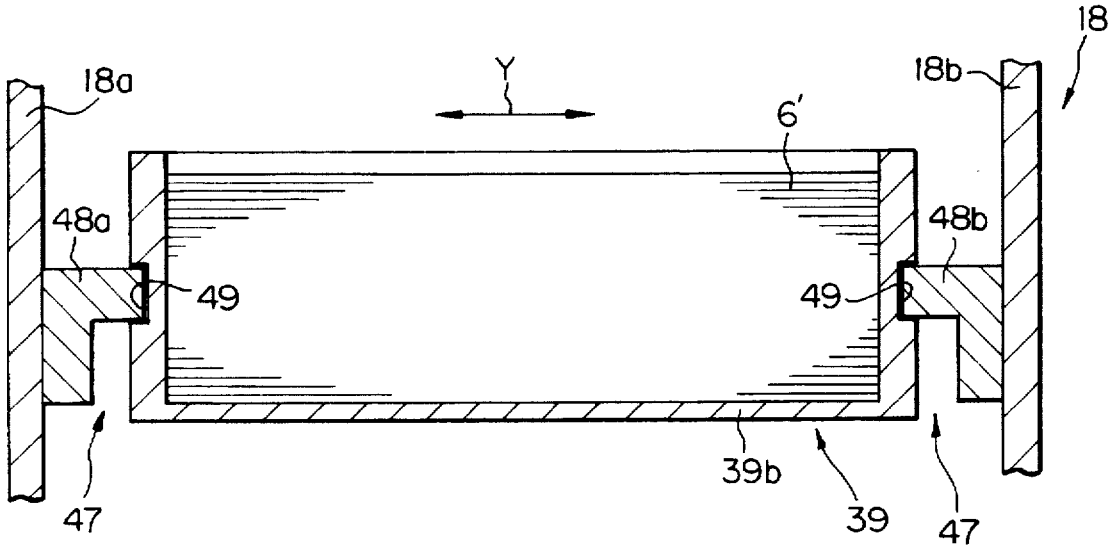
FIG. 7 is a fragmentary sectional side elevation of a cassette mounting and dismounting mechanism also included in the embodiment.
Figure 12:
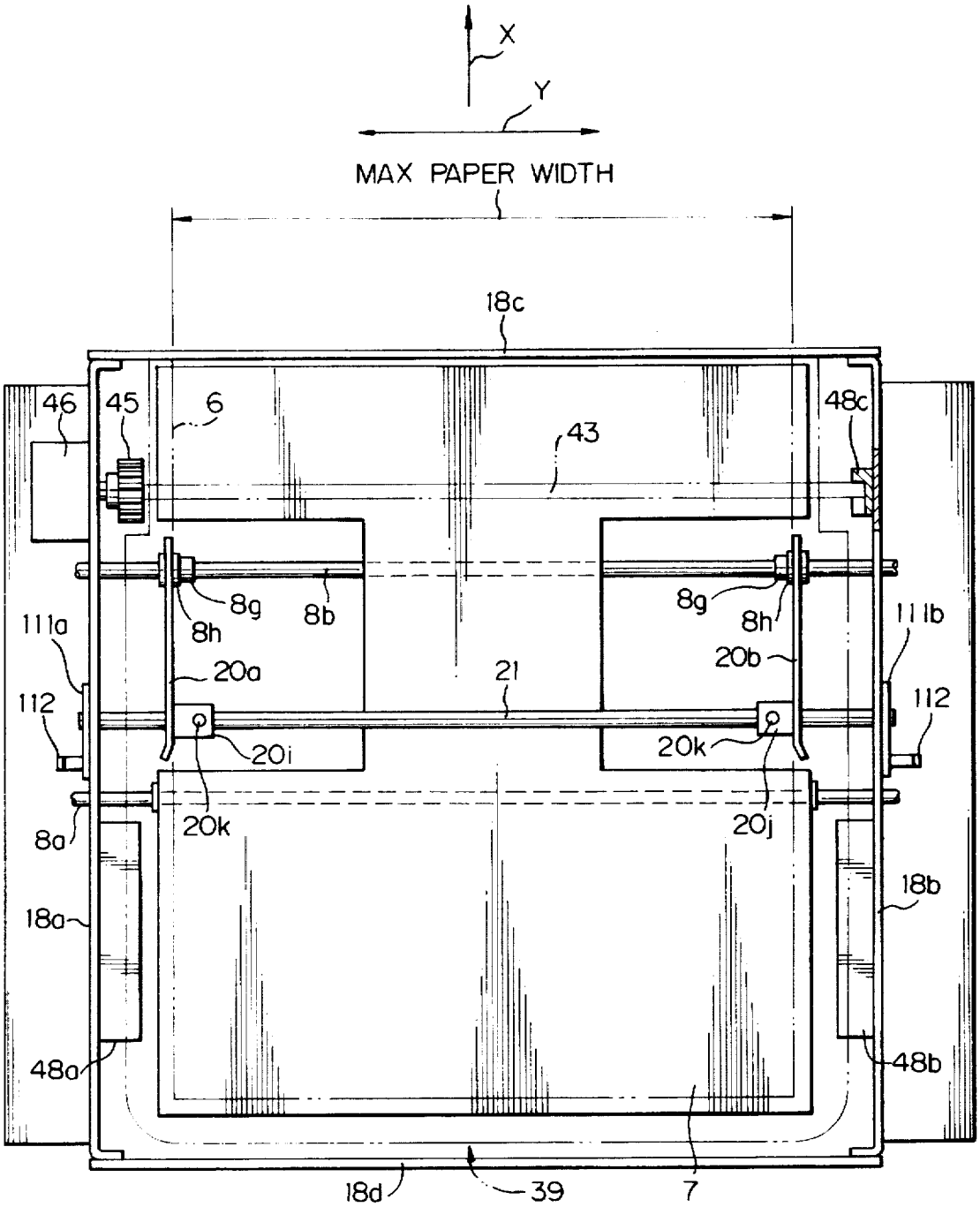
FIG. 12 is a partly sectioned plan view showing the frame, side fences, and tray as well as the construction with the cassette.
Figure 14:
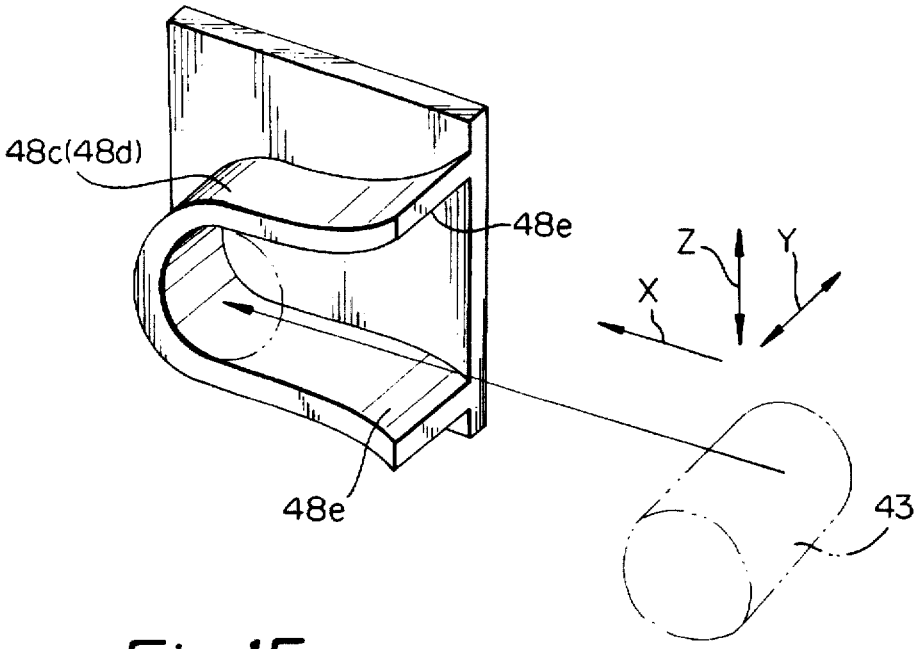
FIG. 14 is a perspective view of a mechanism for positioning the cassette and also included in the embodiment.

As shown in FIG. 7, the mechanism 47 for mounting and dismounting the cassette 39 consists of the cassette guides 48*a* and 48*b* respectively affixed to the upper inside surfaces of the side panels 18*a* and 18*b* of the movable frame 18, and guide channels 49 formed in the cassette 39. The mechanism 47 guides the cassette 39 at the time of mounting and dismounting, and positions the cassette 39 such that it does not contact the pick-up roller 2 or any other member adjoining it. The cassette guides 48*a* and 48*b* play the role of cassette supporting means. As shown in FIGS. 12 and 14, when the cassette 39 is brought to the deepest position along the cassette guides 48*a* and 48*b*, the opposite ends of the arm shaft 43 (indicated by a phantom line in the figures) are respectively engaged with shaft guides 48*c* and 48*d* provided on the inner surfaces of the side panels 18*a* and 18*b*. In the figures, only the shaft guide 48*c* mounted on the side panel 18*b* is shown. The guides 48*c* and 48*d* each has inclined portions 48*e*, and a round portion contiguous with the inclined portions 48*e*. When the cassette 39 is mounted or dismounted, each end of the shaft 43 is brought into the round portion of the associated guide 48*c* or 48*d* via the inclined portions 48*e*. This insures the positioning of the shaft 43 and thereby allows a gear 45, which will be described, and the Sear 44 to accurately mesh with each other. The gear 44 is mounted on one end of the shaft 43. In addition, the above configuration can receive a reaction attributable to the weight of the papers 6' when the shaft 43 is rotated, thereby maintaining the accurate meshing relation during the course of the drive.

As shown in FIGS. 6 and 8, the cassette/tray driving device 40 has a motor or drive means 46 mounted on the upper inner surface of the side panel 18*a*. The drive gear or drive transmission member 45 is mounted on the output shaft of the motor 46, and selectively meshes with the gear 44 when the cassette 39 is mounted or dismounted. The gear 44 is mounted on the cassette 39. A one-way clutch 44*a* is disposed in the gear 44. The device 40 further includes the shaft 43, arm 42, and stack plate 41. The device 40 serves as stack member driving means for moving the stack plate 41 up and down between the upper limit position Pi and the cassette lower limit position Pc. Specifically, the stack member driving means may be considered as consisting of drive means mounting on a casing, and drive member mounted on the inner periphery of the casing and located at a position where it does not interfere with a maximum number of papers stacked on a paper feed tray, and for transmitting the driving force of the drive means to a stack member.

The motor 46 is implemented as a reversible DC motor and electrically connected to the control means 60 via a cassette/tray motor driver 72 (see FIG. 16). The operation of the motor 46 to occur under the control of the control means 60 will be described in detail later.

When the device 100 is seen from above, the arm drive gear 45 is positioned as shown in FIG. 12. In FIG. 12, the paper 6 indicated by a phantom line is the paper existing on the tray 7. The side fences 20*a* and 20*b* are movable away from each other in the direction Y up to the positions shown in FIG. 12; the maximum paper width which the tray 7 can accommodate is indicated by a phantom line. The gear 45 is located outside of the above maximum paper width. Hence, when the top of the paper stack 6 on the tray 7 is brought into contact with the pick-up roller (not shown in FIG. 12), the gear 45 does not interfere with the side edge of the stack 6 adjoining it.

As stated above, the driven gear 44 is provided in addition to the mechanism for moving the stack plate 41 of the cassette 39 up and down (shaft. 43 and arm 42). Further, the drive gear 45 is mounted on the previously mentioned position of the casing (side panel 18*a*) of the paper feeder 100. The Sears 44 and 45 mesh with each other to move the stack plate 41 of the cassette 39 up and down. This makes it needless to provide a drive arm or similar exclusive member for driving the stack plate 41 between the side panels 18*a* and 18*b*; such an exclusive member is apt to interfere with the paper feed using the tray 7. Hence, a single pick-up roller can be shared by the tray 7 and cassette 39. Moreover, the papers 6' stacked on the cassette 39 can be moved up and down without resorting to a bulky mechanism of the type moving the entire cassette loading section up and down. Therefore, the paper feeder 100 is simple in construction, small size, light weight, and easy to assemble.

Figure 15:
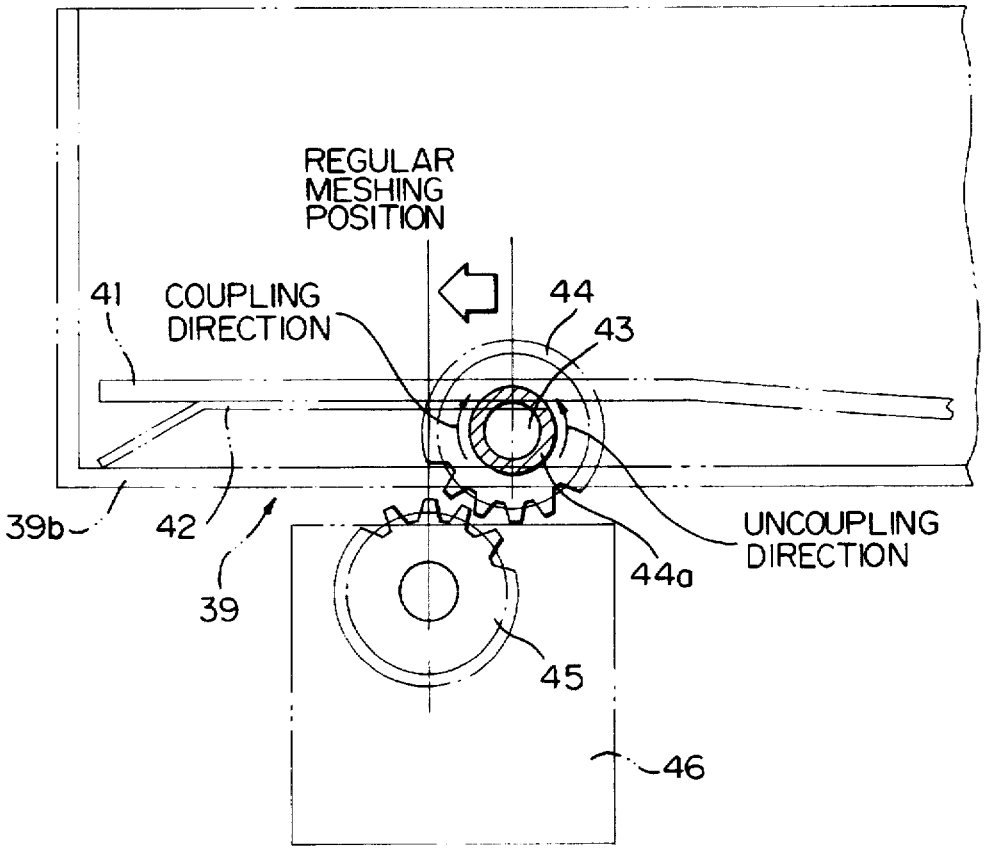
FIG. 15 is a front view showing how a drive member and a driven member further included in the embodiment are brought into mesh with each other.

As shown in FIGS. 6, 8 and 15, when the gear 44 is rotated clockwise, the one-way clutch 44*a* is coupled to cause the shaft 43 to rotate clockwise. When the gear 44 is rotated counterclockwise, the clutch 44*a* is uncoupled and does not transfer the drive to the shaft 43.

More specifically, as shown in FIG. 15, assume that the cassette 39 indicated by a phantom line is inserted into the paper feeder 100 from the right to the left in the direction indicated by a bold arrow. Then, the teeth of the gear 44 contact the teeth of the drive gear 45 before the gear 44*a* reaches the preselected position where it meshes with the gear 45. In this condition, if the cassette 39 is pushed deeper toward the preselected position, and if the one-way clutch 44*a* is absent, the gear 44 and arm 43 tend to rotate counterclockwise, but they cannot do so because the arm 42 is held in the positions shown in FIG. 15. Even if some vibration is applied to the cassette 39 in order to cause the shaft 43 to rotate a little in the clockwise direction, the arm 42 cannot move when the papers 6' are stacked on the stack plate 41 due to the weight of the papers 6'. Should the cassette 39 be pushed deeper into the device 100 in the above condition, the gears 44 and 45 and the portions where they are mounted would be damaged.

By contrast, when the one-way clutch 44*a* is disposed in the gear 44, the gear 44 simply idles relative to the shaft 43 in the uncoupling direction with respect to the counterclockwise rotation. Hence, after the gears 44 and 45 have contacted each other, the gear 44 sequentially meshes with the gear 45 while idling in such a manner as to roll around the gear 45. Hence, the cassette 39 can be smoothly inserted into the device 100 up to the expected meshing position without encountering resistance attributable to the contact of the gears 44 and 45. The gears 44 and 45 as well as their associated parts are free from damage. Although the gear 44 is rotated clockwise in the event of the elevation of the stack plate 41, this direction is the coupling direction of the clutch 44*a*. Hence, the drive is transmitted from the gear 44 to the shaft 43 and allows the stack plate 41 to be elevated. While the clutch 44*a* has been shown and described as being disposed in the driven gear or driven member 44, it may be accommodated in the gear or drive member 45.

A reference will be made to FIGS. 1–9, 11 and 16 for describing the electric control system for controlling the device 100. For clarity's sake, an upper limit sensor 3 is not shown in FIG. 8, and the upper limit sensor 3, an intermediate sensor 4, a paper surface sensor 95 and a lower limit sensor are only schematically shown in FIGS. 1–4 and 6.

As shown in FIG. 9, a tray down key or tray down setting means 67 is positioned on an operation board adjoining the cover 19 of the device 100. After the cover 19 has been opened, the key 67 is continuously pressed for a predetermined period of time in order to set the amount of downward movement of the tray 7. A lamp 94 is built in the key 67 in order to illuminate the portion of the key 67 to be pressed. The lamp 94 is selectively turned on via a lamp driver 93 disposed in a paper feed operation panel 141P, as will be described later. The operation panel 141P is mounted on the upper cover 141.

A right/left key (right) 81 and a right/left key (left) 82 are also arranged on the operation panel 141P. The right/left keys 81 and 82 each has a function of starting the rightward or leftward movement of the movable frame 18 in the direction Y, and a function of setting the amount of displacement by causing its pressing portion to be pressed for a predetermined period of time. In this sense, the keys 81 and 82 play the role of displacement setting means. Pressing portions each faces one of the keys 81 and 82 in order to allow the movable frame 18 to be selectively moved to the right or to the left in the direction Y. The maximum displacement of the frame 18 in the right-and-left direction is selected to be at least 10 mm.

An indicator 83 is provided on the operation panel 141P in the vicinity of the right/left keys 81 and 82. The indicator 83 has a scale and displays the displacement of the movable frame 18 effected via the key 81 or 82 in the direction Y. A pointer potion is affixed to a predetermined position of the printer frame 1F in order to point the above scale, so that the operator can see the displacement of the frame 18. If desired, the two keys 81 and 82 may be replaced with a conventional single see-saw type switch having a pair of pressing portions.

Assume that the operator presses one of the right/left keys 81 and 82 with the intention of moving the papers 6 on the tray 7 or the papers 6' on the cassette 39 to the right or to the left Then, the control means 60 (FIG. 16) sends a command signal to a right/left motor driver 73 included in a right/left driving device 70, thereby causing the motor 32 to rotate in the forward or the reverse direction. As a result, the movable frame 18 is moved relative to the stationary frame 26 to the right or to the left in the direction Y by the previously stated screw mechanism. The displacement of the frame 18 in movement appears on the indicator 83. When the frame 18 is moved a desired distance, the operator stops pressing the key 81 or 82. This deenergizes the motor 32 and thereby brings the frame 18 to a stop. By such a procedure, the papers 6 or 6' are moved together with the frame 18 in the direction Y relative to the printer 1, i.e., the printer frame 1F. Therefore, the operator can adjust the image forming position on the papers 6 or 6' in the direction Y.

The upper limit sensor or sensing means 3 outputs a signal which goes high when the tray 7 or the stack plate 41 of the cassette 39 is raised until the top of the paper stack 6 or 6' has contacted the pick-up roller 2 with an adequate pressure and raised it to an adequate paper feed position, i.e., when the uppermost paper 6 or 6' arrives at the upper limit position P1 adequate for the pick-up roller 2 to pick it up. Only when the output of the sensor 3 is in a high level, the pick-up roller 2 can feed the uppermost paper 6 or 6'. The sensor 3 is implemented by a conventional interruption type optical sensor having a light emitting portion and a light-sensitive portion. Specifically, the sensor 3 is provided with a rotatable piece capable of contacting the top paper 6 or 6', while a screen plate is interlocked with the rotatable piece and interrupts the optical path between the light emitting portion and the light-sensitive portion. The sensor 3 is mounted on the printer frame 1F in the vicinity of the pick-up roller 2. Japanese Patent Laid-Open Publication No. 2-265825, for example, shows in FIG. 3 an optical sensor PS2 which may be used as the above sensor 3.

The lower limit sensor or sensing means 5 is responsive to die lower limit position P3 of the tray 7. As shown in FIGS. 1–4, the sensor 5 is mounted on a predetermined position of the inner surface of the side panel 18*a*. The sensor 5 is implemented by a conventional reflection type sensor having a light emitting portion and a light-sensitive portion. When the light emitting portion of the sensor 5 emits light toward one side of the tray 7, the light-sensitive portion receives the resulting reflection and shows that the tray 7 has been brought to the lower limit position P3. The output of the sensor 5 goes high only when the tray 7 is located at the position P3.

The intermediate sensor or sensing means 4 is responsive to an intermediate position P2 between the limit positions P1 and P3 and where the tray 7 should be brought to a stop. As shown in FIGS. 1–4, the sensor 4 is mounted on a predetermined position of the inner surface of the side panel 18*a*. The sensor 4 is implemented by a conventional reflection type optical sensor having a light emitting portion and a light-sensitive portion. When the light emitting portion emits light toward one side of the tray 7, the light-sensitive portion receives the resulting reflection and shows that the tray 7 has been brought to the intermediate position P2. The output of the sensor 4 goes high only when the tray 7 is located at the position P2. The sensor 4 is spaced 100 mm above the lower limit sensor 5.

As shown in FIGS. 1, 2, 5 and 6, the paper surface sensor or sensing means 95 is used to stop the tray 7 at a sensing position P4 between the upper limit position P1 and the intermediate position P2 and corresponding to a predetermined paper surface height. For this purpose, the sensor 95 senses the upper side edge (top) of the paper stack 6 loaded on the tray 7 moving up or down and stopped in between the side fences 20*a* and 20*b*. The sensor 95 is mounted on the side wall of the side fence 20*b* (or side fence 20*a*), and implemented by a conventional reflection type 15 optical sensor having a light emitting portion and a light-sensitive portion. When the light emitting portion emits light toward the upper side edge (top) of the paper stack 6 or the other side of the tray 7, the light-sensitive portion receives the resulting reflection. The output of the sensor 95 goes high only when the reflection is incident to the light-sensitive portion.

The above sensor 95 is positioned on the side fence 20*b* or 20*a* in the direction Z such that at the predetermined upper position Pa which is the highest position of the side fences 20*a* and 20*b*, a gap capable of accommodating about 500 to 1,500 papers is formed when the top of the paper stack 6 and the pick-up roller 2 are spaced about 100 mm from each other. The above number of papers depends on the thickness of papers and is about 1,000 when it comes to fine quality 55 kg papers.

Referring to FIG. 16, the control means 60 is comprised of a microcomputer including I/O (Input/Output) ports 64, a CPU (Central Processing Unit) 63, a ROM (Read Only Memory) 61, a RAM (Random Access Memory) 62, and a timer 65. These constituents of the control means 60 are interconnected by a signal bus. The control means 60 are provided on a control board, not shown, which is located at a predetermined position of the printer frame 1F. The control means 60 is electrically controlled to printer control means which is not shown for clarity's sake. The printer control means also provided on the control board controls the entire operation of the printer 1, including printing, and is also implemented as a microcomputer. The printer control means and control means 60 execute various procedures, which will be described, in response to the outputs of various keys, including a perforation start key and a print start key, not shown, arranged on the operation panel, not shown, which is mounted on the top of the printer 1.

The upper limit sensor 3, intermediate sensor 4, lower limit sensor 5, paper surface sensor 95, right/left keys 81 and 82, and tray down key 67 are electrically connected to the control means 60. The outputs of the sensors 3, 4, 5 and 95 and keys 81, 82 and 67, i.e., ON/OFF signals and data signals are sent to the input ports of the control means 60 assigned thereto. The control means 60 sends commands signals 60 to the motor driver 71 of the tray driving device 10, the motor driver 72 of the cassette/tray driving device 40, the motor driver 73 of the right/left driving device 70, the lamp driver 93, and right/left indicator 83 via its output ports, as needed.

The control means 60 interchanges command signals and/or ON/OFF signals and data signals with the sensors 3, 4, 5 and 95, keys 81, 82 and 67, motor drivers 71, 72 and 73, lamp driver 93, and indicator 83, thereby controlling the entire system including the starts, stops, and timings of the paper feeder 100.

When the print start key or the perforation start key is pressed, the control means 60 sets up a timing for starting driving the tray motor 11 in the forward direction (clockwise), i.e., a timing for starting raising the tray 7. When the tray down key 67 is pressed, the control means 60 sets up a timing for starting driving the motor 11 in the reverse direction (counterclockwise), i.e., a timing for starting lowering the tray 7.

When the perforation start key or the print start key is pressed or when the cover 19 is closed after the mounting of the cassette 39, the control means 60 determines a timing for starting driving the cassette/tray motor 46 in the forward direction (counterclockwise), i.e., a timing for raising the stack plate 41.

Further, when the right/loft key (right) 81 or the right/left key (left) 82 is pressed, the control means 60 sets up a timing for starting driving the right/left motor 32 in the forward direction or the reverse direction, i.e., a timing for starting moving the movable frame 18 to the right or the left.

The CPU 63 stops the tray 7 at the intermediate position P2 on receiving an ON signal from the intermediate sensor 4. When the tray down key 67 is continuously pressed for more than a predetermined period of time (3 seconds in the embodiment), the CPU 63 causes, in response to the resulting ON signal from the lower limit sensor 5, the tray motor 11 to stop the tray 7 at the lower limit position P3 without accepting the ON signal from the sensor 4. Further, when the papers 6 are to be fed from the tray 7, and at least in a stand-by condition following the power-up of the paper feeder 100, the CPU 63 causes, in response to the ON signal from the paper surface sensor 95, the tray driving device 10 to bring the tray 7 to a stop at the sensing position P4. In addition, only when the tray 7 is ready to be lowered, the CPU 63 causes the lamp 94 to glow; only when the lamp 94 is glowing, the CPU 63 allows the tray driving device 10 to lower the tray 7.

The timer 65 counts the duration of hold-down of the tray down key 67 and input via the input port of the control means 60, and feeds it to the CPU 63, as needed. Also, the timer 65 counts the time after the start of rotation of the pick-up roller 2 in order to detect a jam around the roller 2. The ROM 61 stores a program relating to the starts, stops and timings of the paper feeder 100, and necessary data. The RAM 62 is used to temporarily store the results of computation executed by the CPU 63, and stores the ON/OFF signals and data signals output from the sensors and keys, as needed.

In operation, the printer 1 performs the conventional procedure including the discharge of a used master, the reading of a document image, the perforation of a stencil for making a master, and the feed of the master, and then produces a trial printing. Thereafter, when the print start key is pressed, a paper feeding step, printing step, and paper discharging step are repeated in the same manner as during trial printing a number of times corresponding to a desired number of printings. Specifically, when the perforation start key or the print start key is pressed, the control means 60 sands a paper feed command to the paper feeder 100. In response, the tray motor 11 is driven in the forward direction so as to raise the tray 7. When the upper limit sensor 3 senses the top of the paper stack 6 of the tray 7 brought to the adequate paper feed position, the control means 60 sends a stop signal to the motor 11 for thereby stopping the rotation of the motor 11. As a result, the top of the paper stack 6 is held at the upper limit position P1. Then, the pick-up roller 2 starts feeding the paper 6 from the top of the stack in the conventional manner.

The operation of the lamp driver 93 is as follows. The CPU 63 determines the status of the paper feeder 100 on the basis of the outputs of the various sensors and the program stored in the ROM 61. Only if the tray 7 is ready to be lowered, the CPU 63 sends a command signal to the lamp driver 93 via its output port so as to cause it to turn on the lamp 94. If the tray 7 cannot be lowered, the CPU 63 inhibits the lamp driver 93 from turning on the lamp 94.

For example, when the lower limit sensor 5 is in an ON state, i.e., when the tray 7 is held at the lower limit position P3, the CPU 63 prevents the lamp driver 93 from turning on the lamp 94. This is because it is not necessary to lower the tray 7 below the position P3, and because lowering it below the position P3 would cause an excessive load to act on the tray driving device 10. In the other conditions, the CPU 63 causes the lamp driver 93 to turn on the lamp 94 because the tray 7 must be lowered when the papers 6 should be replenished, when a jam occurs, or when the cassette 39 should be mounted.

When the lamp 94 is not turned on, the CPU 63 does not send the tray down command to the motor driver 71 even if the ON signal output from the tray down key 67 arrives. As a result, the motor 11 is not rotated. When the lamp 94 is turned on, the motor 11 is driven by the motor driver 71 in response to the ON signal from the tray down key 67.

As stated above, when the tray 7 cannot be lowered, the lamp 94 built in the tray down key 67 remains turned off. Hence, if "TRAY DOWN key is valid only when its press portion is glowing." or similar message is carried in, e.g., an operation manual, the operator will be prevented from taking the above occurrence for an error attributable to mechanical conditions.

The embodiment inhibits the tray 7 from being lowered only when the lower limit sensor 5 is in an ON state, i.e., when the tray 7 is held in the lower limit position P3. If desired, this can also be done under conditions which would result in the malfunction of the paper feeder 100 or the movement of the cassette 39, and conditions which would result in operator's erroneous operation. Further, in the illustrative embodiment, when the tray 7 is moving downward, the lamp 94 is caused to blink in order to inform the operator of the downward movement. This allows the operator to see that the paper feeder 100 is operating normally, and that further depression of the tray down key 67 is invalid, thereby enhancing the efficient operation of the paper feeder 100.

Figure 17:
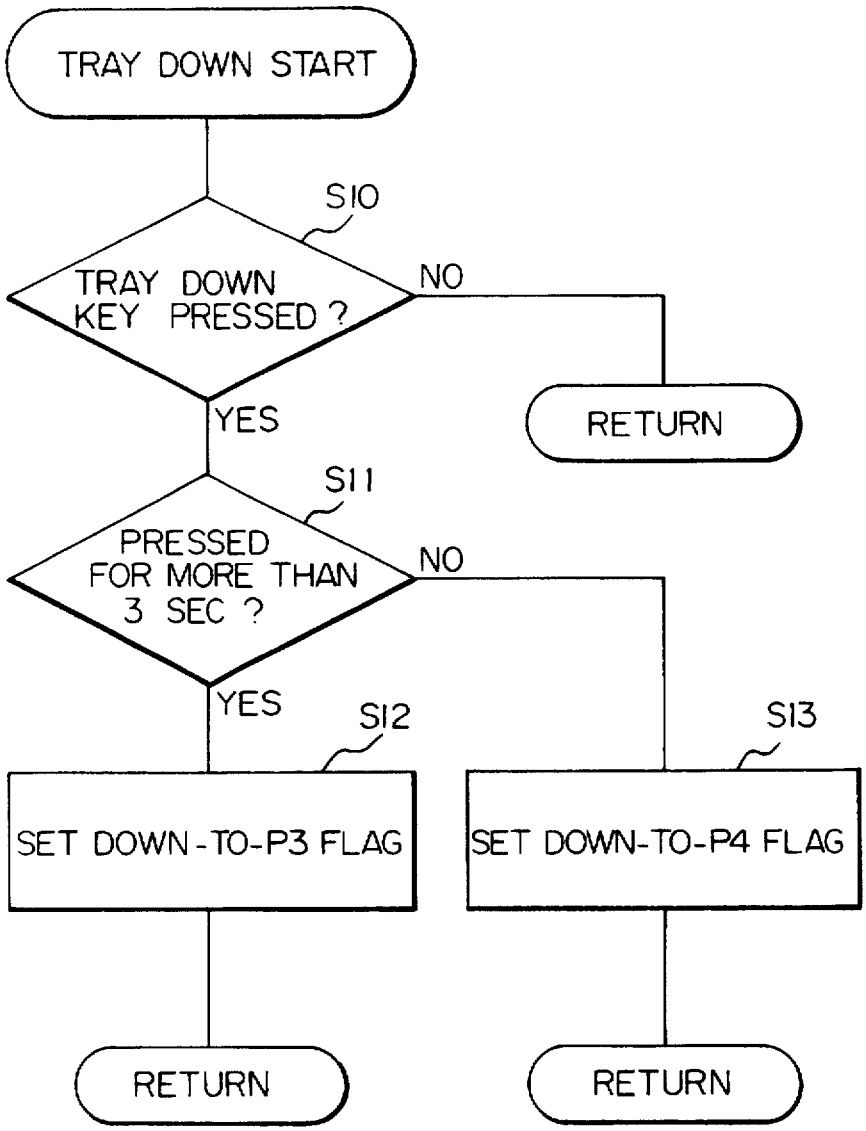
FIGS. 17–21 are flowcharts each demonstrating a specific operation of the embodiment.
Figure 18:
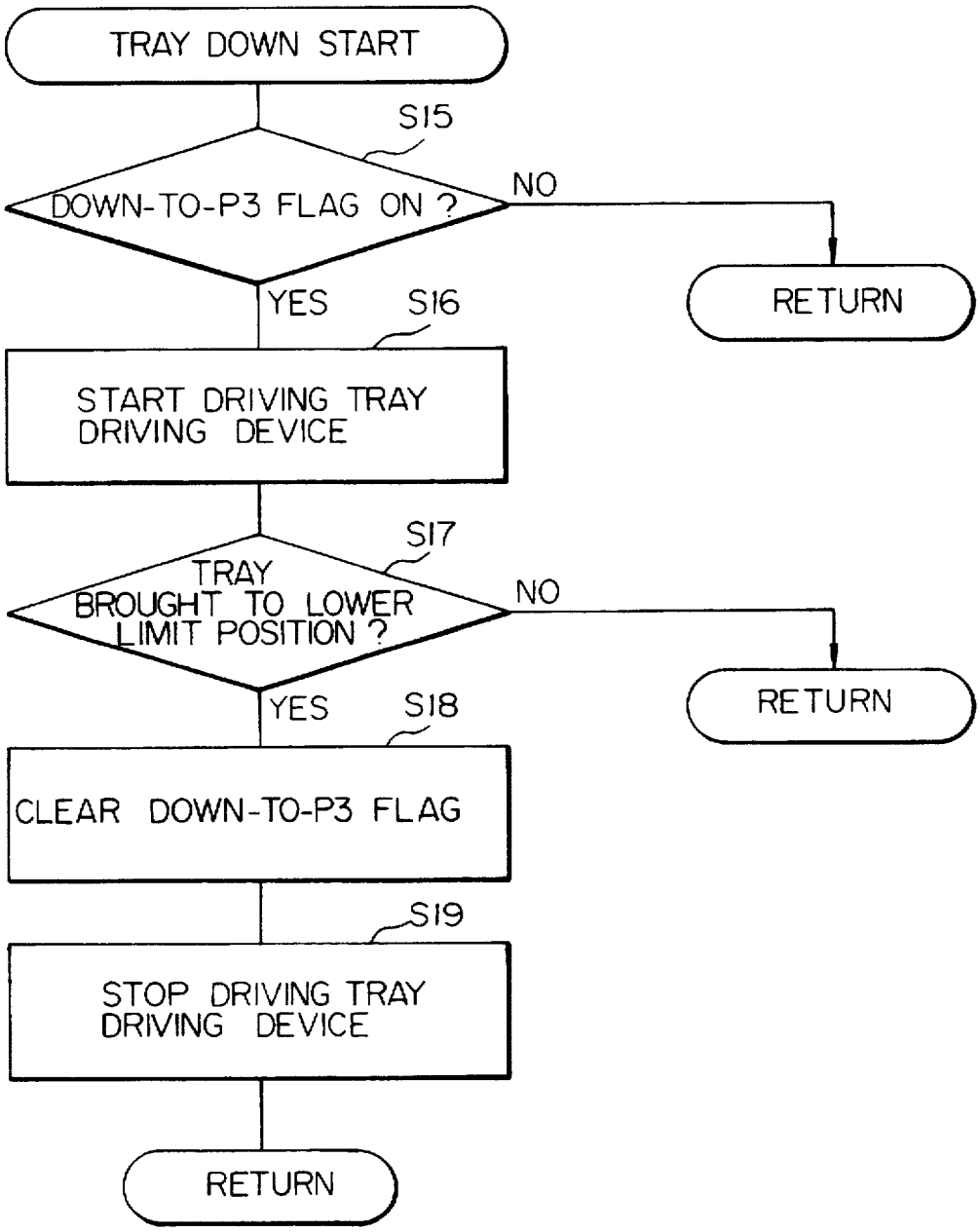
Figure 19:
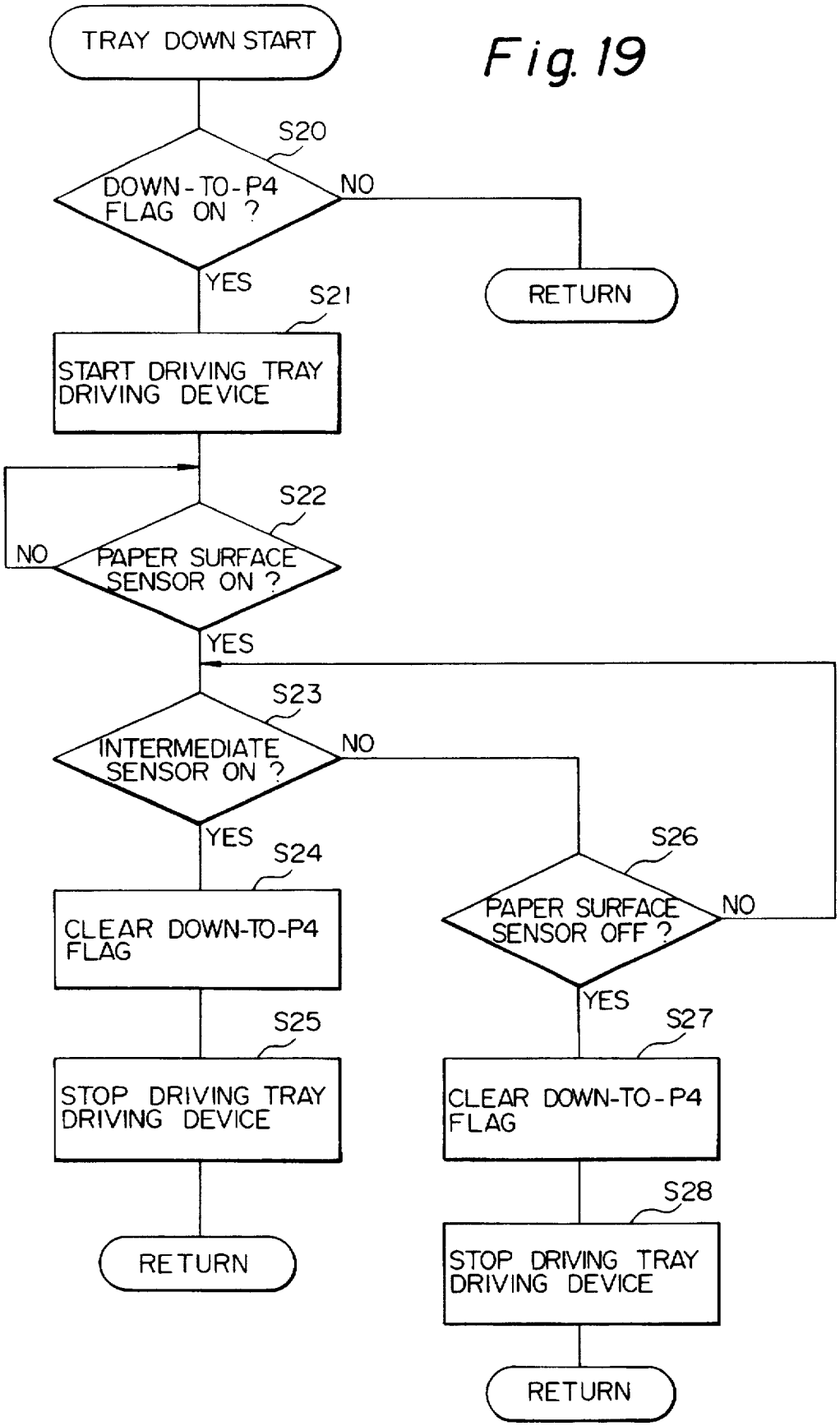

A reference will also be made to FIGS. 17–19 for describing the control over the downward movement of the tray 7. In the embodiment, the control means 60 switches the lower limit position assigned to the tray 7, depending on the duration of depression of the tray down key 67 Hence, it is possible to stop the tray 7 at the paper surface sensing position P4 or the intermediate position P2 when the above duration is, e.g., shorter than 3 seconds, or to stop it at the lower limit position P3 when the duration is longer than 3 seconds inclusive.

FIG. 17 demonstrates how the control means 60 selects either the position P4 or the position P3, depending on the duration of depression of the key 67. First, assume that the key 67 is pressed for more than 3 seconds inclusive. When the control means 60 determines that the key 67 has been pressed (YES, step S10), it determines whether or not the key 67 has been pressed for more than three seconds inclusive (step S11). If the answer of the step S11 is positive (YES), the control means 60 sets a down-to-P3 flag in order to lower the tray 7 to the lower limit position P3 (stop S12). On the other hand, if the duration of depression of the key 67 is less than 3 seconds (NO, step S11), the control means 60 sets the down-to-P4 flag in order to lower the tray 7 to the paper surface sensing position P4 (step S13).

FIG. 18 shows a tray down procedure in which the control means 60 controls the tray driving device 10 after setting the down-to-P3 flag. First, on determining that the down-to-P3 flag has been set (YES, step S15), the control means 60 starts driving the device 10, i.e., starts lowering the tray 7 (step S16). Then, the control means 60 determines whether or not the tray 7 has reached the tower limit position P3 (step S17). On the arrival of the tray 7 at the position P3 (YES, step S17), the control means 60 clears the down-to-P3 flag (step S18), stops driving the device 10 (step S19), and then ends the tray down procedure.

FIG. 19 shows a tray down procedure based on the down-to-P4 flag. As shown, on determining that the down-to-P4 flag has been set (YES, step S20), the control means 60 starts driving the device 10, i.e., starts lowering the tray 7 (step S21). Then, the control means 60 determines whether or not the paper surface sensor 95 is in an ON state (step S22), for the following reason. The following procedure includes a step of causing the device 10 to stop the downward movement of the tray 7 when the sensor 95 is in an OFF state. Specifically, it may occur that at the time when the tray 7 starts moving downward, the tray 7 itself is positioned above the sensor 95 because the number of papers 6 left on the tray 7 is small. In this case, the movement of the tray 7 is immediately stopped. In order to avoid such a stop of the tray 7, the tray 7 is once lowered until the upper side edge of the paper stack 6 on the tray 7 has been sensed by the sensor 95.

If the answer of the step S22 is YES, the control means 60 further lowers the tray 7 via the device 10, and then determines whether or not the intermediate sensor 4 is in an ON state (step S23). If the answer of the step S23 is negative (NO), the control means 60 determines whether or not the sensor 95 has gone OFF (step S26). If the answer of the step S26 is NO, the program returns to the step S23. If the answer of the step S26 is YES, meaning that the top of the paper stack 6 on the tray 7 has been lowered below the sensor 95, the control means 60 clears the down-to-P4 flag (step S27), and then stops driving the device 10 (step S28). As a result, the tray 7 is brought to a stop at a position where the top of the paper stack 6 is slightly lower than the sensor 95. If the answer of the step S23 is YES, meaning that the intermediate sensor 4 has gone ON before the top of the paper stack 6 has been lowered to the sensor 95, then the control mean s 60 clears the down-to-P4 flag (step S24), and then stops driving the device 10 (step S25). Consequently, the tray 7 is stopped at the intermediate position P2.

In this manner, the tray 7 is stopped at the paper surface sensing position P4 when the number of papers 6 on the tray 7 is relatively small, and is stopped at the intermediate position P2 even when the number of papers 6 is relatively great. When the tray 7 is stopped at the position P4 in the step S28, additional papers can be replenished into the tray 7 over the existing papers 6. After the replenishment, the key 67 may be pressed again for less than 3 seconds. Then, the tray 7 will be lowered to the position P4 again. Such a procedure may be repeated in order to sequentially replenish papers into the tray 7.

When the tray 7 is held at the paper surface sensing position P4, the top of the paper stack 6 and the pick-up roller 2 arc spaced about 100 mm from each other. This distance is great enough to accommodate 1,000 fine quality 55 kg papers which are usually packed together. Hence, every time the key 67 is pressed, the whole pack of papers 6 can be replenished into the tray 7. When the tray 7 is lowered down to the intermediate position P2, it cannot be lowered any further. In this condition, papers 6 whose amount exceeds the distance between the top of the paper stack on the tray and the pick-up roller 2 cannot be replenished. This prevents an excessive number of papers from being loaded on the tray 7.

When the key 67 is pressed for more than 3 seconds inclusive to lower the tray 7 down to the lower limit position P3, an additional space is available between the top of the paper stack 6 and the pick-up roller 2 and corresponding to the distance between the upper limit position P1 and the intermediate position P2. However, during the movement of the tray 7 toward the position P3, the frame 28 and upper shaft 21 are moved downward along with the tray 7. Hence, when the cover 19 is opened to uncover the opening 58A communicated to the cassette loading space 39S, the upper shaft 21 faces the opening 58A and obstructs the replenishment of papers 6 into the tray 7. As a result, the distance between the top of the paper stack 6 on the tray 7 and the bottom of the upper shaft 21 and, therefore, the number of papers 6 which it can accommodate does not change. This prevents an excessive number of papers 6 from being loaded on the tray 7.

Figure 20:
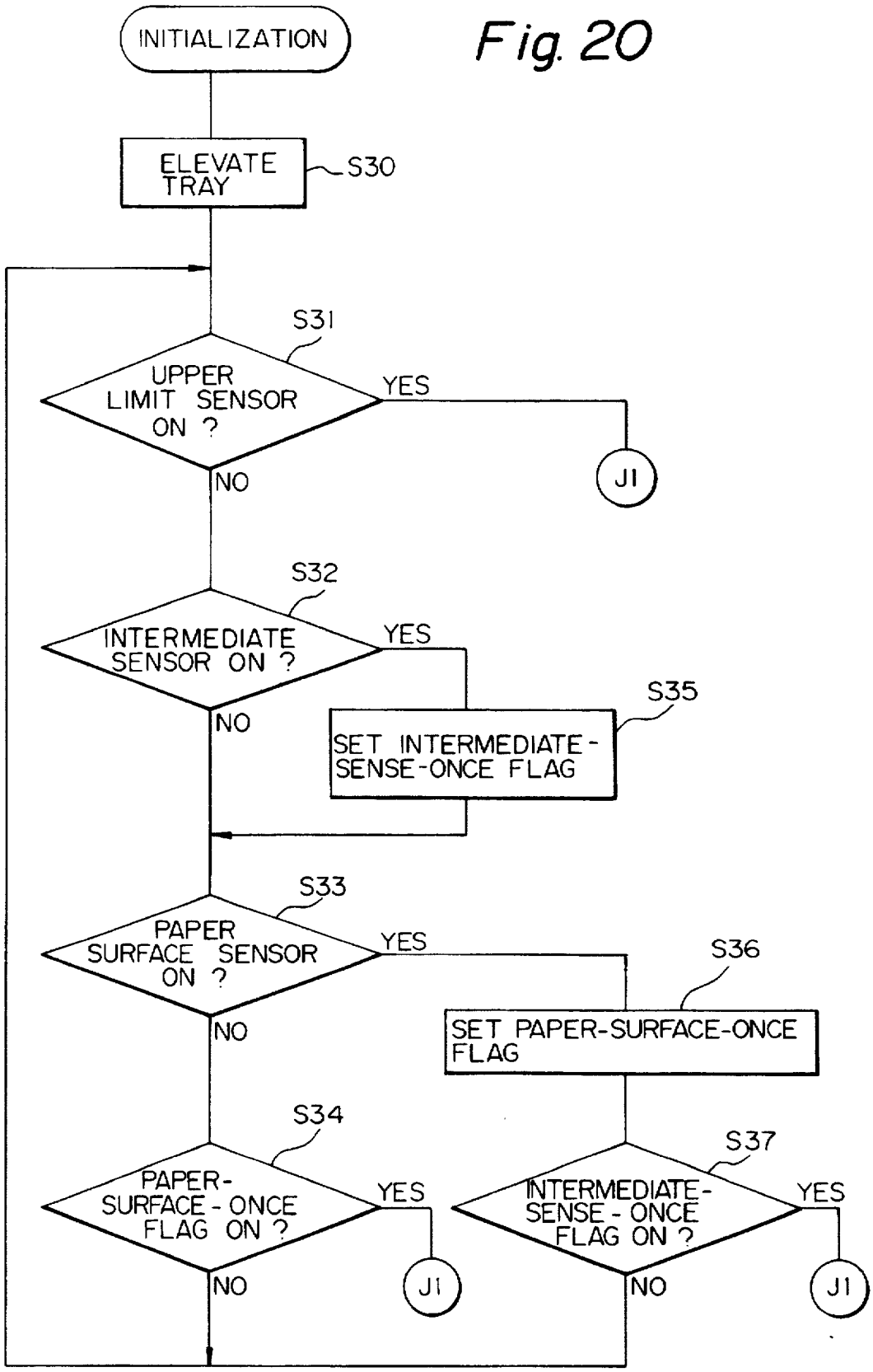
Figure 21:
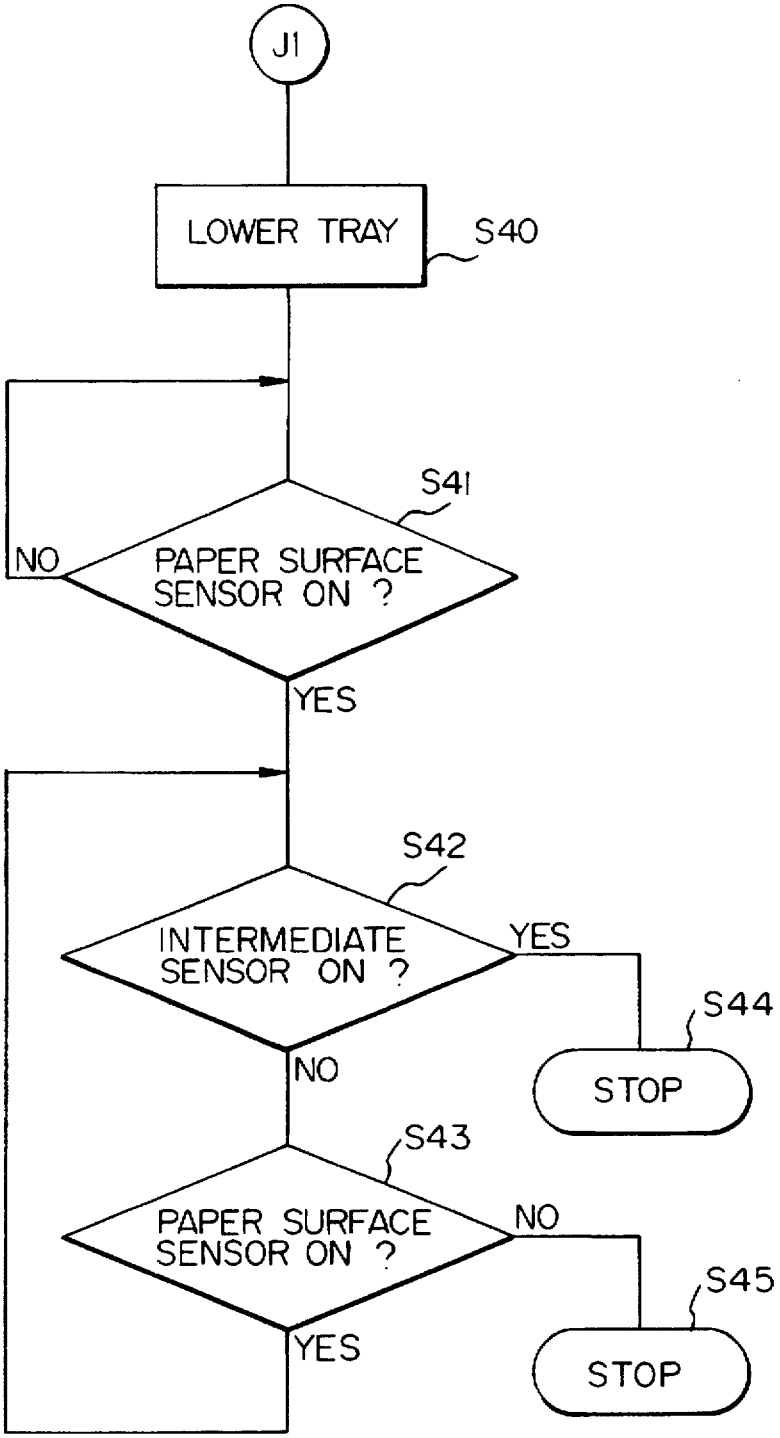

FIGS. 20 and 21 demonstrate how the tray 7 is initialized on the power-up of the paper feeder 100. First, in FIG. 20, on the power-up, the control means 60 causes the device 10 to elevate the tray 7 (step S30) because the position of the tray 7 is not known. Then, when the upper limit sensor 3 goes ON, meaning that the top of the paper stack 6 on the tray 7 has reached the paper feed position (YES, step S31), the program enters into a tray down mode, as indicated by J1.

Assume that the upper limit sensor 3 is in an OFF state because the top of the paper stack 6 is far lower than the upper limit position P1 (NO, step S31). Then, the control means 60 determines whether or not the intermediate sensor 4 has gone ON (step S32). If the answer of the step S32 is YES, the control means 60 sets an intermediate-sense-once flag (step S35) in order to memorize that the sensor 4 has gone ON once. This is followed by a step S33. When the tray 7 is located between the positions P4 and P2, the sensor 4 does not go ON; this is also followed by the step S33. In the step S33, the control means 60 determines whether or not the paper surface sensor 95 has gone ON. If the answer of the step S33 is YES, the control means 60 sets a paper-surface-once flag in order to memorize that the sensor 95 has sensed the paper surface once. (step S36). Subsequently, the control means 60 determines whether or not the intermediate-sense-once flag is set (step S37). If the answer of the step S37 is YES, meaning that the tray 7 was located below the intermediate position P2 at the beginning of the elevation, the control means 60 determines that the tray 7 has moved away from the position P2, and that the top of the paper stack 6 has been sensed. Then, the control means 60 enters into the previously mentioned tray down mode (J1) because the top of the paper stack 6 does not have to be raised to the position P1.

If the answer of the step S37 is NO, meaning that the tray 7 was located between the positions P2 and P4 at the beginning of the elevation, the control means 60 returns to the step S31. As a result, the tray 7 is continuously elevated until the top of the paper stack 6 arrives at the position P1.

Assume that while the above loop is repeated due to the negative answer of the step S37, the paper surface sensor 95 goes OFF (NO, step S33). This occurs, e.g., when the number of papers 6 remaining on the tray 7 is so small that the tray 7 is elevated even after the turn-on of the sensor 95, i.e., the sensor 95 is positioned below the tray 7. Then, the control means 60 determines whether or not the paper-surface-once flag has been set. Because this flag has been set, the control means 60 also enters into the tray down mode (J1).

The above steps S31, S32, S33, and S34→S31 are repeated if the initial position of the tray 7 at the time of elevation is between the positions P2 and P4, and until the sensor 95 goes ON.

FIG. 21 shows the tray down mode (J1) for lowering and then stopping the tray 7. As shown, the control means 60 causes the tray 7 to start moving downward (step S40), and then determines whether or not the sensor 95 is in an ON stare (step S41). The step S41 is significant for the following reason. It may occur that when the tray 7 starts moving downward from the position where the sensor 3 goes ON, the sensor 95 is positioned below the tray 7 due to the small number of papers left on the tray 7, as stated earlier. In this case, the sensor 95 goes OFF. However, the procedure of FIG. 21 is programmed such that when the sensor 95 is in an OFF state, the downward movement of the tray 7 is stopped. Therefore, if the turn-on of the sensor 95 is not confirmed once in the step S41, the tray 7 will be stopped immediately after the start of the downward movement.

When the sensor 95 goes ON (YES, step S41), the control means 60 determines whether or not the intermediate sensor 4 is in an ON state (step S42). If the answer of the step S42 is YES, the control means 60 stops driving the device 10 (step S44). As a result, the tray 7 is brought to a stop at the intermediate position P2 (allowing the maximum number of papers to be stacked on the tray 7). If the answer of the step S42 is NO, the control means 60 determines whether or not the paper surface sensor 95 is in an ON state (step S43). If the answer of the step S43 is NO, the control means 60 stops driving the device 10. As a result, the tray 7 is brought to a stop at a position slightly lower than the position where the sensor 95 is expected to sense the top of the paper stack 6 (upper side edge of the stack 6).

On the power-up of the paper feeder 100, the tray 7 is lowered to and stopped at the paper surface sensing position P4, as stated previously. Hence, if the number of papers 6 on the tray 7 is small, as determined before the start of printing, additional papers 6 can be immediately replenished into the tray 7 over the existing papers 6. Further, even when papers 6 do not have to be replenished, the top of the paper stack 6 existing on the tray 7 is constantly held at a position about 100 mm below the pick-up roller 2. Stated another way, even when the number of papers 6 present on the tray is small, the tray 7 should only be elevated about 100 mm at the beginning of paper feed. This prevents the waiting time up to the start of paper feed from increasing. In addition, even if the sensor 95 does not go OFF due to a great number of papers 6 remaining on the tray 7, the tray 7 is stopped at the intermediate position P2. Hence, an excessive number of papers 6 which would increase the load on the motor 11 is prevented from being stacked on the tray 7.

For example, assume that the papers 6 are sequentially fed after the tray 7 has been elevated from the position shown in FIGS. 1 and 2 to the position where the top of the stack 6 on the tray 7 contacts the pick-up roller 2, and that a jam occurs around the roller 2, or additional papers 6 should be replenished under the above condition. Then, to lower the tray 7, the operator presses the key 67 for less than 3 seconds. In response to the ON signal from the key 67, the control means 60 reverses the motor 11 and thereby lowers the tray 7. When the paper surface sensor 95 senses the tray 7 at the position P4, the control means 60 sends a drive stop signal to the motor 11. As a result, the reverse rotation of the motor 11 is stopped, so that the tray 7 is held at the position P4. This obviates the needless downward movement of the tray 7 and allows the operator to remove a jamming paper or to replenish additional papers 6. Furthermore, because the top of the stack 6 on the tray 7 is positioned about 100 mm below the pick-up roller 2, as shown in FIGS. 1 and 2, the tray 7 should only be elevated about 100 mm. Hence, the operator can again start the paper feed in a relatively short waiting time.

Assume that a jam occurs around the pick-up roller 2 when the tray 7 is located at the intermediate position P2, as shown in FIG. 3, with the top of the stack 6 contacting the roller 2, i.e., when the tray 7 is in a full load condition. Then, because the tray 7 has already been located at the position P2, the tray 7 does not move downward if the key 67 is pressed for less than 3 seconds. In such a case, the key 67 is pressed for more than 3 seconds inclusive. In response, the control means 60 reverses the motor 11 and thereby lowers the tray 7. When the lower limit sensor 5 senses the tray 7 brought to the lower limit position P3, the control means 60 sends a drive stop signal to the motor 11. As a result, the reverse rotation of the motor 11 is stopped, and the tray 7 is held at the position P3. Because the sensors 4 and 5 are spaced 100 mm from each other, a space of 100 mm is available between the top of the stack 6 and the pick-up roller 2 at the end of the downward movement of the tray 7. The above space is great enough for the operator to remove the jamming paper.

Hence, when the tray 7 is in a substantially full load condition, and when a jam occurs around the pick-up roller 2, it is not necessary for the operator to remove the entire stack 6 from the tray 7 in order to produce a space for removing the jamming paper, as has been customary.

The device 100 is operated with the cassette 39 mounted thereto, as follows. As shown in FIG. 3, assume that the tray 7 is located at the intermediate position P2 where the top of the stack 6 contacts the pick-up roller 2, i.e., the tray 7 is in its full load or substantially full load condition. Then, a space for mounting the cassette 39 to the device 100 is not available. Also, because the tray 7 has already been brought to the intermediate position P2, the tray 7 does not move downward if the tray down key 67 is pressed for less than 3 seconds. To produce the above necessary space, the key 67 is pressed for more than 3 seconds inclusive. As a result, the tray 7 is lowered by the control means 60 until it bas been sensed by the lower limit sensor 5 at the lower limit position P3. At this instant, because the lower shaft 22 is pressed downward by the underside of the tray 7 against the action of the tension springs 114 (see FIG. 10), the side fences 20*a* and 20*b* and frame 28 are lowered to their positions indicated by solid lines in FIG. 6 (phantom lines in FIGS. 1 and 2).

Consequently, the space 39S is formed between the upper ends of the side fences 20*a* and 20*b* and the underside of the case 39*b* to be inserted into the device 100. Because the distance between the sensors 4 and 5 is 100 mm, a space which is more than 100 mm high is available between the pick-up roller 2 and the top of the stack 6 at the end of the downward movement of the tray 7 (see FIG. 6). The cassette 39 is about 50 mm to 80 mm thick, as stated previously. Hence, when the cassette 39 is mounted to the predetermined portion of the paper feeder 100, a space of at least 20 mm to 50 mm is formed between the pick-up roller 2 and the top of the stack 6' in the direction Z. Therefore, the space 39S great enough to insert the cassette 39 is guaranteed. In this condition, when the operator opens the cover 19 and then fully mounts the cassette 39 via the mechanism 47 in the right-and-left direction, the driven gear 44 is brought into mesh with the drive gear 45. Subsequently, the operator closes the cover 19.

When the cassette 39 is mounted to the paper feeder 100, the operator presses the perforation start key or the print start key. Then, the control means 60 sends a paper feed command signal to the cassette/tray driving device 40. In response, the device 40 rotates the motor 46 counterclockwise in FIG. 8, i.e., in the forward direction. The motor 46 causes the arm 42 to rotate clockwise via the gears 45 and 44. As a result, the arm 42 raises the free end portion of the stack plate 41 in the clockwise direction until the top paper 6' contacts the pick-up roller 2, i.e., reaches the paper feed position or upper limit position P1. Then, the forward drive of the motor 46 is stopped so as to hold the top paper 6' at the position P1. Subsequently, the pick-up roller 2 starts feeding the paper 6' in the conventional manner.

To remove the cassette 39 from the paper feeder 100, the operator opens the cover 19 in the direction shown in FIG. 9, and then palls out the cassette 39 to the right as viewed in the figure.

In FIG. 7, the stack plate 41 and its associated members are not shown for clarity's sake. Also, in FIG. 8, the upper limit sensor 3 and separator rollers 51*a* and 51*b* as well as their associated members are not shown.

As described above, in the illustrative embodiment, when either the cassette 39 or the tray 7 is used, only the top panel 18*g* is positioned above the cassette 39 or the side fences 20*a* and 20*b*. Hence, the paper feeder 100 is selectively operable in the cassette feed mode using the cassette 39 or the tray feed mode using the tray 7 without resorting to an exclusive space above the pick-up roller 2.

The upper limit sensor 3 may be replaced with a reflection type optical sensor, if desired. Likewise, the intermediate sensor 4 and lower limit sensor 5 may each be implemented by an interruption type optical sensor using, e.g., a screen plate mounted on one side of the tray 7, or by a microswitch. The paper surface sensor 95 may also be implemented by an interruption type optical sensor or a microswitch.

Auxiliary means may be used to stop the tray 7 at the intermediate position or the lower limit position P3 without fail in response to the output of the sensor 4, 95 or 5. For example, use may be made of braking means shown in, e.g., FIG. 1 of Japanese Patent Laid-Open Publication No. 1-187125. The braking means is made up of a brake disk mounted on the other end of the output shaft of the tray motor 11, and a solenoid for pressing a brake shoe against the disk.

Of course, 3 seconds used as a reference period of time for determining whether the tray should be lowered to the intermediate position P2 or whether it should be lowered to the lower limit position P3 is only illustrative, and may b e replaced with any other suitable period of time matching, e.g., the user's preference.

The mechanical displacement indicator 83 may be replaced with a conventional displacement sensor and an electrically operated displacement indicator. Then, the control means 60 will cause the displacement indicator to indicate a displacement in response to the output of the displacement sensor. In such a case, the displacement sensor is implemented by, e.g., an encoder mounted on the end of the frame drive shaft 30 (see FIG. 11) or a sensor using a variable resistor, while the displacement indicator is implemented by, e.g., LEDs (Light Emitting diodes) or an LCD (Liquid Crystal Display).

The worm 12 and worm wheel 13*a* (see FIG. 4) constituting the tray driving device 10 may be replaced with simple spur wheels.

As to the biasing means, the spring 114 may be replaced with an elastic member made of rubber or similar elastic material so long as it has a spring characteristic and durability comparable with those of the spring 114.

While the pick-up roller 2 has been shown and described as being mounted on the printer frame 1F in the paper feed section 58, it may be mounted on the paper feeder 100, if desired.

In the embodiment, the paper feeder 100 is removable from the printer frame 1F. Of course, the the paper feeder 100 may be affixed to the printer frame 1F. The device 100 is, of course, applicable not only to the stencil printer 1 but also to a copier, ordinary printer, facsimile apparatus, or similar image forming apparatus.

Among the various constituents of the paper feeder 100, the cassette 39, cassette mounting and dismounting mechanism 47 and cassette/tray driving device 40 may be omitted. The resulting configuration is shown in FIGS. 1–3 by way of example.

Further, the paper feeding device in accordance with the present invention may comprise paper feeding means for feeding a paper from the top of a paper stack while separating it from the other papers at a paper feed position, a tray loaded with the paper stack and movable up and down between an upper limit position where it faces the paper feed position and a lower limit position, tray driving means for moving the tray between the two positions, lower limit sensing means responsive to the lower limit position of the tray, tray down setting means for setting a downward movement of the tray, an illuminating device for illuminating an operating portion included in the tray down setting means, and control means for causing the illuminating device to glow only when the tray can be moved downward, and causing the tray driving means to lower the tray only when the illuminating device is glowing.

In summary, it will be seen that the present invention provides a large capacity paper feeder for an image forming apparatus and having various unprecedented advantages, as enumerated below.

(1) When a tray is moved downward by tray driving means, a frame is also lowered in interlocked relation to the tray. As a result, a space for inserting a cassette capable of storing a plurality of papers is formed between the top of the frame and paper feeding means. Side fences are supported by the frame in such a manner as to be movable up and down between a predetermined upper position and a predetermined lower position assigned to a casing. In addition, the side fences are constantly biased by biasing means until they reach the predetermined upper position of the casing. The tray can be moved by tray driving means up to an upper limit position where it faces a paper feed position. A single paper feeding means sequentially feeds papers, one at a time, surely positioned by the side fences in their widthwise direction toward the image forming apparatus. This miniaturizes the apparatus, simplifies the mechanism and structure, makes it needless to provide an exclusive space for LCT paper feed above the paper feeding means, and does not increase the overall height of the apparatus.

(2) With the single paper feeding means, it is possible to selectively feed papers from the tray or a removable cassette. This makes it needless to switch a transport path between the paper feeding means and an image forming section included in the apparatus, and a paper feed timing. As a result, devices, adjustment and control customarily used to maintain the paper feed timing constant in the presence of a plurality of paper feeding means are not necessary. This is particularly desirable for a stencil printer in which even a slightest difference in paper feed timing results in a noticeable deviation in the top-and-bottom position of an image. Because the transport path between the paper feeding means and the image forming section remains the same, the device can be mounted to a conventional image forming apparatus without complicating the transport path or making maintenance difficult, and can meet the need for high-speed paper feed. Hence, the paper feeder of the present invention is extremely convenient to use.

(3) When the cassette is inserted into the device, a drive member located within the casing at a position where it does not interfere with the fully loaded tray, and a driven member are engaged with each other and transfer the output torque of driving means to a stack member. Hence, when the cassette is removed from the device, nothing obstructs the movement of the tray. Hence, papers can be selectively fed in a cassette feed mode or in a tray feed mode.

(4) When the drive member and driven member are engaged with each other, a one-way clutch transfers the drive torque to one of the two members in a direction for raising the stack member. Hence, even when the positions of the drive member and driven member relative to each other is deviated, one of them in which the clutch is disposed is displaced in the slipping direction of the clutch. This prevents the force necessary for the engagement of the two members from increasing due to the weight of the papers stacked on the cassette, and insures the engagement.

(5) A fence driving mechanism moves the side fences up and down between the predetermined upper position and lower predetermined position of the casing. The fence driving mechanism consists of biasing means, and a fence moving member forming a part of the frame and for lowering the side fences in contact with the underside of the tray by being selectively interlocked to the downward movement of the may. This obviates the need for an exclusive mechanism for moving the side fences up and down, and having a great dimension in the up-and-down direction. This further simplifies the overall mechanism and structure. In addition, with a simple construction, it is possible to move the side fences up and down along with the tray over a necessary range.

(6) Assume that papers are sequentially fed from the tray. Then, at least in a stand-by condition following the power-up of the paper feeder, control means causes tray driving means to stop the tray at the position of a paper height in response to the output of paper surface sensing means. Hence, a preselected space is formed between the top of the papers stacked on the tray and the paper feeding means. The space is great enough to facilitate the replenishment of papers, but small enough to minimize a waiting time up to the start of paper feed. Hence, even when the number of papers left on the tray is small, the tray is brought to a stop at the same position, thereby preventing the waiting time from increasing.

(7) When the tray down setting means is operated for more than a predetermined period of time, the control means causes the tray driving means to stop the tray at the lower limit position in response to the output of lower limit sensing means. Hence, the single tray down setting means can implement, without increasing the number of parts or the cost, both the operation for lowering the tray to the intermediate position for the removal of a jamming paper or the replenishment of papers, and the operation for lowering the tray to the lower limit position for the removal of a jamming paper when the tray is located at the intermediate position and fully loaded, or for the insertion of the cassette.

(8) The control means causes the illuminating device to glow only when the tray can be lowered, and causes the tray driving means to lower the tray only when the illuminating device is glowing. Therefore, by pressing the tray down setting means, the operator can readily see if the tray is ready to be lowered or not. This enhances the easy and efficient operation of the paper feeder, and eliminates wasteful serviceman calls.

(9) An openable cover is provided only in the opening of the casing communicated to the cassette loading space Therefore, it is not necessary for the operator to open a bulky cover in the event of loading or unloading the cassette is replenishing papers to the tray or the cassette. That is, a cover needs a minimum of space for opening and closing, it facilitates the loading and unloading of the cassette and the replenishment of papers into the cassette or the tray. Further, a mold for producing the cover is reduced in size, and therefore in cost. In addition, there is no fear that operator stacks papers in unexpected positions.

(10) An LCT capable of stacking papers greater number than the maximum number of papers to be stacked the cassette is included in the device. Hence, at least one the above advantages (1)–(9) is achievable.

(11) The control means causes the illuminating means glow only when the tray can be lowered, and causes the driving means to lower the tray only when the illuminating means is glowing. Therefore, by pressing the tray down setting means, the operator can readily see if the tray is ready to be lowered or not. This enhances the easy an d efficient operation of the device, and eliminates wasteful serviceman calls. This is also true when the paper feeder is provided with a conventional construction.

Various modifications will become possible for those skilled in the art after receiving the teachings of the present disclosure without departing from the scope thereof.

What is claimed is:

1. A dual mode paper feeder for an image forming apparatus and having a single paper feeding means positioned at a paper feed opening for feeding a paper from a top of a paper stack at a paper feed position in an intended direction of paper feed, while separating the paper from other papers when operating in a tray mode of operation and feeding another paper from a plurality of papers in a cassette when operating in a cassette mode of operation, said paper feeder comprising:

a casing constituting an outside frame member of said paper feeder;

a pair of side fences disposed in said casing and movable up and down for positioning opposite edges of the paper stack in a widthwise direction perpendicular to the intended direction of paper feed;

a frame supporting said pair of side fences such that said pair of side fences are movable up and down between a predetermined upper position and a predetermined lower position of said casing;

biasing means for constantly biasing said frame upward relative to said casing;

a tray loaded with the paper stack and movable up and down between an upper limit position facing the paper feed position and a lower limit position remotest from the upper limit position, and for selectively causing said frame to move downward when said tray is moved downward;

tray driving means for moving said tray between the upper limit position and the lower limit position; and cassette supporting means mounted on said casing for removably supporting the cassette which is capable of being loaded with said plurality of papers, wherein said plurality of papers need not be identical in size to said paper in said paper stack, wherein when said tray is lowered to the lower limit position, a space is formed between a top of said frame and the paper feeding means for mounting the cassette to be used in said cassette mode of operation.

2. A paper feeder as claimed in claim 1, further comprising:

a stack member loaded with the papers of said cassette and movable between the upper limit position facing the paper feed position and a cassette lower limit position remotest from said upper limit position; and stack member driving means for selectively moving said stack member to the upper limit position or to the cassette lower limit position;

wherein when said cassette is not mounted to said paper feeder, the papers are fed from said tray at the paper feed position while, when said cassette is mounted, the papers are fed from the cassette at the paper feed position.

3. A paper feeder as claimed in claim 2, wherein said stack member driving means comprises:

driving means mounted on said casing;

a drive member mounted on an inside surface of said casing and at a position where said drive member does not interfere with the papers stacked on said tray in a maximum number, and for transferring a driving force of said driving means to said stack member; and a driven member mounted on said cassette and for selectively engaging with said drive member to thereby cause said stack member to move up or down.

4. A paper feeder as claimed in claim 3, wherein said stack member driving means further comprises a one-way clutch disposed in one of said drive member and said driven member, and for transferring the driving force in a direction in which said stack member moves upward.

5. A paper feeder as claimed in claim 1, further comprising:

paper surface sensing means responsive to a height position of a top portion of the papers stacked on said tray; and control means for causing, when the papers are to be fed from said tray and at least in a waiting condition following a power-on of said paper feeder, said tray driving means to stop said tray at the height position in response to an output of said paper surface sensing means.

6. A paper feeder as claimed in claim 1, further comprising:

lower limit sensing means for sensing the lower limit position of said tray;

tray down setting means operated for a predetermined period of time for setting an amount of a downward movement of said tray; and control means for causing said tray down setting means to be operated for more than the predetermined period of time, and thereby causing said tray driving means to stop said tray at said lower limit position in response to an output of said lower limit sensing means.

7. A paper feeder as claimed in claim 6, further comprising an illuminating device for illuminating a portion of said tray down setting means to be operated, wherein said control means causes said illuminating device to glow only when said tray is ready to be lowered, and causes said tray driving means to lower said tray only when said illuminating device is glowing.

8. A paper feeder as claimed in claim 1, further comprising an openable cover provided in an open portion of said casing which is in communication with said space.

9. A paper feeder as claimed in claim 1, wherein said tray comprises a large capacity table capable of being loaded with a number of papers greater than a maximum number of papers to be stacked on said cassette.

10. A paper feeder for an image forming apparatus and having a single paper feeding means positioned at a paper feed opening and for feeding a paper from a top of a paper stack at a paper feed position in an intended direction of paper feed, while separating the paper from other papers, said paper feeder comprising:

a casing constituting an outside frame member of said paper feeder;

a pair of side fences disposed in said casing and movable up and down for positioning opposite edges of the paper stack in a widthwise direction perpendicular to the intended direction of paper feed;

a frame supporting said pair of side fences such that said pair of side fences are movable up and down between a predetermined upper position and a predetermined lower position of said casing;

biasing means for constantly biasing said frame upward relative to said casing;

a tray loaded with the paper stack and movable up and down between an upper limit position facing the paper feed position and a lower limit position remotest from the upper limit position, and for selectively causing said frame to move downward when said tray is moved downward;

tray driving means for moving said tray between the upper limit position and the lower limit position; and cassette supporting means mounted on said casing for removably supporting a cassette which is capable of being loaded with a plurality of papers;

wherein when said tray is lowered to the lower limit position, a space is formed between a top of said frame and the paper feeding means for mounting the cassette;

said paper feeder further comprising a fence driving mechanism for moving said pair of side fences positioned between the predetermined upper position and the predetermined lower position up and down, wherein said fence driving mechanism comprises said biasing means, and a fence moving member forming a part of said frame and causing said pair of side fences to move downward when engaged with an underside of said tray in association with a downward movement of said tray.

* * * * *